US010633914B2

(12) United States Patent
Runze et al.

(10) Patent No.: US 10,633,914 B2
(45) Date of Patent: Apr. 28, 2020

(54) SPACER FOR INSULATING GLASS PANES

(71) Applicant: ENSINGER GMBH, Nufringen (DE)

(72) Inventors: Peter Runze, Schwandorf (DE); Marc Rehling, Steinenbronn (DE); Michael Möller, Cham (DE); Bernhard Königsberger, Tiefenbach (DE)

(73) Assignee: ENSINGER GMBH, Nufringen (DE)

( * ) Notice: Subject to any disclaimer, the term of this patent is extended or adjusted under 35 U.S.C. 154(b) by 0 days.

(21) Appl. No.: 16/014,488

(22) Filed: Jun. 21, 2018

(65) Prior Publication Data

US 2018/0298673 A1 Oct. 18, 2018

Related U.S. Application Data

(63) Continuation of application No. PCT/EP2016/076658, filed on Nov. 4, 2016.

(30) Foreign Application Priority Data

Dec. 23, 2015 (DE) ..... 10 2015 122 716
Aug. 12, 2016 (DE) ..... 10 2016 115 023

(51) Int. Cl.
*E06B 3/663* (2006.01)

(52) U.S. Cl.
CPC .. *E06B 3/66319* (2013.01); *E06B 2003/6638* (2013.01); *E06B 2003/66385* (2013.01); *E06B 2003/66395* (2013.01)

(58) Field of Classification Search
CPC ..... E06B 2003/6638; E06B 3/66319; E06B 2003/66385; E06B 2003/66395
See application file for complete search history.

(56) References Cited

U.S. PATENT DOCUMENTS 5,374,466 A * 12/1994 Bleasdale ..... B29C 33/0016 249/113
6,250,045 B1 * 6/2001 Goer ..... E06B 3/66314 52/172

(Continued)

FOREIGN PATENT DOCUMENTS

CN 103354857 A 10/2013
DE 93 03 795 U1 7/1994

(Continued)

OTHER PUBLICATIONS

International Search Authority, International Search Report for International Application No. PCT/EP2016/076658, dated Mar. 3, 2017.

(Continued)

*Primary Examiner* — Brian E Glessner
*Assistant Examiner* — Daniel J Kenny
(74) *Attorney, Agent, or Firm* — Leydig Voit & Mayer, Ltd.

(57) ABSTRACT

A spacer for insulating glass panes comprises a profile body made using a first plastics material, which has a substantially U-shaped cross section with first and second side walls arranged in parallel, each having a free end and an inner wall extending between the first and the second side wall, and a vapor diffusion barrier made of a poorly heat conducting material, extending from the free end of the first side wall to the free end of the second side wall, wherein the vapor diffusion barrier is arranged substantially in parallel to and spaced apart from the inner wall. The profile body together with the vapor diffusion barrier encloses a cavity of the spacer which is optionally configured to accommodate a desiccant.

30 Claims, 12 Drawing Sheets

(56) References Cited

U.S. PATENT DOCUMENTS

| | | | | |
|---|---|---|---|---|
| 6,537,629 | B1 * | 3/2003 | Ensinger | E06B 3/66319 428/156 |
| 9,683,404 | B2 * | 6/2017 | Baumann | E06B 3/66319 |
| 10,132,114 | B2 * | 11/2018 | Siodla | E06B 3/66319 |
| 2011/0200812 | A1 * | 8/2011 | Tomamoto | B65H 18/28 428/220 |
| 2012/0202902 | A1 * | 8/2012 | Wissemborski | C08J 9/08 521/85 |
| 2013/0212957 | A1 | 8/2013 | Cempulik et al. | |
| 2014/0311065 | A1 | 10/2014 | Schreiber | |
| 2015/0107167 | A1 | 4/2015 | Baumann et al. | |
| 2016/0201381 | A1 | 7/2016 | Kuster et al. | |
| 2016/0207726 | A1 * | 7/2016 | Ortner | B65H 20/00 |
| 2017/0183258 | A1 * | 6/2017 | Ottermann | B65D 85/48 |
| 2017/0298680 | A1 | 10/2017 | Schreiber et al. | |
| 2018/0344053 | A1 * | 12/2018 | Schreiber | A47F 3/0434 |

FOREIGN PATENT DOCUMENTS

| | | | |
|---|---|---|---|
| DE | 298 07 419 | U1 | 5/1999 |
| DE | 198 07 454 | A1 | 8/1999 |
| DE | 10 2010 049 806 | A1 | 5/2012 |
| DE | 10 2015 105 960 | A1 | 1/2014 |
| EP | 1 889 995 | A1 | 2/2008 |
| EP | 2 930 296 | A1 | 10/2015 |
| EP | 3 009 590 | A1 | 4/2016 |
| WO | WO 84/01798 | A1 | 5/1984 |
| WO | WO 2012/100961 | A1 | 8/2012 |
| WO | WO 2012/140005 | A1 | 10/2012 |
| WO | WO 2013/104507 | A1 | 7/2013 |
| WO | WO 2014/005950 | A1 | 1/2014 |
| WO | WO 2015/043848 | A1 | 4/2015 |
| WO | WO 2016/046081 | A1 | 3/2016 |
| WO | WO 2016/058977 | A1 | 4/2016 |

OTHER PUBLICATIONS

International Bureau, English translation of International Preliminary Report on Patentability in International Application No. PCT/EP2016/076658, dated Jul. 5, 2018.

* cited by examiner

SPACER FOR INSULATING GLASS PANES

CROSS-REFERENCE TO RELATED APPLICATIONS

This patent application is a continuation of International Patent Application No. PCT/EP2016/076658, filed on Nov. 4, 2016, which claims the benefit of German Patent Application No. 10 2015 122 716.9, filed on Dec. 23, 2015, and 10 2016 115 023.1, filed on Aug. 12, 2016, which are incorporated herein by reference.

BACKGROUND OF THE INVENTION

The invention relates to a spacer for insulating glass panes, comprising a profile body made using a first plastics material, having a main body with a substantially U-shaped cross section with first and second side walls arranged in parallel and an inner wall extending between the first and the second side wall. The spacer further comprises a vapor diffusion barrier extending from a free end of the first side wall to a free end of the second side wall. Further, the vapor diffusion barrier is arranged substantially in parallel to and spaced apart from the inner wall.

Spacers for insulating glass panes of the kind described hereinabove are disclosed in the prior art, for example in EP 1 889 995 A1 and in DE 10 2012 105 960 A1.

Such spacers known in the prior art are frequently used in place of the previously commonly used spacers made of metal for improving the thermal insulation of insulating glass planes in windows, doors, facade elements, and the like, in order to hold two or more glass panes, which form the insulating glass pane, in parallel position to each other.

Spacers processed to a frame, together with the glass panes in the assembled state of the insulating glass pane, form an interspace between the panes.

The glass panes are typically bonded to the spacer using a sealant. The interspace between the panes is sealed by bonding the spacer and the glass panes with a sealant adhering to the spacer and to the glass panes. As disclosed, for example, in DE 198 07 454 A1, sealants such as butyl adhesive, polysulfide, polyurethane, and silicone materials are used.

It is important for spacers for insulating glass panes that they have a high heat transfer resistance, such that an insulation that is as good as possible may be ensured.

Furthermore, it is of importance to configure the spacer in such a way that as little water vapor as possible is able to penetrate into the interspace between the panes from the outside, so that condensation effects may be avoided in the case of a large difference between inner and outer temperatures.

Water and water vapor, respectively, which has penetrated should be removed from the interspace between the panes. For this purpose, a cavity formed by the spacer is often filled with desiccant. The capacity of the desiccant is limited, however, such that the interspace between the panes being closed off also by the spacer in a gastight, in particular moisture-tight, manner is of vital importance.

Here it is of importance to configure the spacer such that also the vapor diffusion barrier seals the interspace in between the panes in a water vapor-tight manner, but that its contribution to the heat conduction is nonetheless kept as small as possible.

Vapor diffusion barriers made of metal (cf. DE 93 03 795 U1) are often used in common spacers made of plastic. Full-metal films made, i.e., of aluminum or steel have a pronouncedly good heat conductivity of about 200 and 50 W/(K·m), respectively, and thereby reduce the heat transfer resistance of the spacer overall.

The object of the present invention is to propose a spacer that accounts for the aforementioned problems to the greatest possible extent and, moreover, that may be produced economically.

BRIEF SUMMARY OF THE INVENTION

This object is achieved in accordance with the invention by an article with the features of claim 1.

Unlike in the prior art, the spacer in accordance with the invention comprises a profile body made using a first plastics material and a vapor diffusion barrier made of a sheet material which is poorly heat conducting.

The heat transfer resistance of the spacer is increased by the poorly heat conducting characteristics of the vapor diffusion barrier in comparison to spacers having a full-metal vapor diffusion barrier.

Spacers in the form of hollow profiles closed in cross section are disclosed, for example, in DE 10 2012 105 960 A1 (FIGS. 1 to 5) and in DE 93 03 795 U1. In these closed hollow profiles, a closed cavity is formed by the profile body itself, seen in cross section perpendicular to the longitudinal direction.

In the spacer in accordance with the invention, the profile body and the vapor diffusion barrier together form a cavity that is closed only by the vapor diffusion barrier on the side opposite to the inner wall. The vapor diffusion barrier of the spacer in accordance with the invention is made of a sheet material. Due to this feature in combination with the vapor diffusion barrier of the spacer in accordance with the invention being made of a poorly heat conducting material, the heat conduction between the glass panes may be reduced and thus the total heat transfer resistance of the spacer in accordance with the invention may be increased.

Because the cavity of the spacer in accordance with the invention is optionally only closed by the vapor diffusion barrier made of a sheet material, a spacer with identical construction height may be produced with reduced weight in comparison to a hollow profile.

Additionally, it is possible that, with identical overall construction height, a larger volume for accommodating desiccant is created, whereby the capacity for absorbing water vapor out of the interspace between the panes may be increased. The spacer in accordance with the invention and, correspondingly, the insulating glass panes having a spacer in accordance with the invention may thus have a longer life span.

DETAILED DESCRIPTION OF THE INVENTION

In a preferred embodiment, the spacer in accordance with the invention comprises a vapor diffusion barrier made of a poorly heat conducting sheet material that is different from the first plastics material.

In an alternative preferred embodiment of the spacer in accordance with the invention, the poorly heat conducting sheet material of the vapor diffusion barrier is substantially identical to the first plastics material.

The fact that the profile body is made using a first plastics material and the vapor diffusion barrier is made of a sheet materially and optionally of a material different from the first plastics material enables an optimized material selection in comparison to integrally formed spacers based on closed hollow profiles. The selection may be optimized both with respect to the heat conductivity, material costs, and tightness of the vapor diffusion barrier against water vapor on the one hand, and with respect to the heat transfer resistance of the profile body on the other hand. Thus, an overall optimized heat transfer resistance for the spacer in accordance with the invention in comparison to the conventional integrally formed spacers may be achieved.

The heat transfer of spacers is often determined in their installed state in the insulating glass panes. This heat transfer coefficient with respect to the unit of length is indicated by the so-called psi-value. The psi-value is dependent on the construction of the insulating glass panes, and on the material and construction of the spacer frame. The basis for determining the psi-value is the equivalent heat conductivity of the spacer measured in accordance with ift-guideline WA-17/1.

The spacer in accordance with the invention preferably has an equivalent heat conductivity in accordance with this guideline of 0.14 W/(m·K) or less.

Poorly heat conducting for the purposes of the invention means that the equivalent heat conductivity of the profile body is changed by the vapor diffusion barrier by no more than 0.014 W/(K·m).

The vapor diffusion barrier of the spacer in accordance with the invention is made of a sheet material and may in particular be made of an adequately flexible material.

The profile body of the spacer in accordance with the invention comprises a main body having a substantially U-shaped cross section with first and second side walls arranged in parallel and an inner wall extending between the first and the second side wall. The first and the second sidewall each have a free end which is spaced apart from the inner wall. The vapor diffusion barrier extends from the free end of the first side wall to the free end of the second side wall.

In particular, the vapor diffusion barrier also extends over regions of the side walls and abuts them from the exterior, such that the vapor diffusion barrier may be supported by the side walls and assume the contour specified by them. At the same time, the adhesion of the sealant to the spacer may be optimized by the design of the surface of the vapor diffusion barrier.

The free ends of the first and second side wall preferably each have a chamfered end region, wherein the chamfered end regions are inclined toward each other. The chamfered end regions increase the torsional rigidity of the spacer in accordance with the invention and facilitate the manufacture of the spacer to a frame.

In particular the vapor diffusion barrier abuts the chamfered end regions from the exterior and is configured to be supported by them.

The chamfered end regions of the first and second side wall are preferably substantially in planar form, so that the flexible vapor diffusion barrier may better abut on them.

The chamfered end regions of the first and second side wall preferably have substantially equal extension, seen in cross section perpendicular to the longitudinal direction. The spacer may thus have a symmetrical cross section seen transversely to the longitudinal direction.

In the described preferred embodiment of the spacer in accordance with the invention, in which the first and second side wall have chamfered end regions, the chamfered end regions maintain a spacing between each other. This space is closed by the vapor diffusion barrier, so that the profile body and the vapor diffusion barrier form a cavity closed in cross section, which is closed in regions only by the vapor diffusion barrier, which is made of a sheet material. Also in this embodiment, the weight of the spacer in accordance with the invention is typically reduced in comparison to spacers with a closed outer wall. Moreover, the spacer in accordance with the invention may also have a high heat transfer resistance with this geometry.

The chamfered end regions of the first and second side walls seen in cross section perpendicular to the longitudinal direction of the profile body are preferably formed at an obtuse angle, in particular at an angle of about 100° to about 150°, toward the first and second side wall to the cavity, respectively. In particular, they each have an acute angle to the inner wall, preferably an angle of about 80° to about 30°. The spacer is preferably formed in a trapezoidal cross section perpendicular to the longitudinal direction.

Preferably, in the installed state of the spacer in the insulating glass pane, substantially triangular volumes seen in cross section, which are configured to accommodate sealant, are formed by the chamfered end regions of the first and second side wall and by the glass panes. Thus, a larger contact surface of spacer and glass panes to the sealant may be obtained in comparison to rectangular profiles, and an improved bonding to the glass panes may be achieved.

It is possible to bend the spacer to form corner regions upon for manufacturing the frame. The bending may be facilitated and the geometry of the spacer in the corner regions may be stabilized by the chamfered end regions of the first and second side wall.

Alternatively, the spacer may be cut into pieces corresponding to the dimensions of the frame. The pieces may then be connected with a corner connector and connected in a force-fit or material bonding manner, in particular also welded, for the formation of the frame.

In accordance with a further embodiment, the profile body in accordance with the invention comprises an outer wall, which, in accordance with a first variant, has first and second wall segments spaced apart from each other, which may optionally be arranged in a plane. The first and second wall segments are each connected to the free end of the first and second side wall, respectively. The first and second wall segments extend away from the respective side wall and toward each other, and in particular are aligned substantially in parallel to the inner wall. Here, too, the cavity closed in cross section is only closed by applying the vapor diffusion barrier. By saving material in regions, in addition to the economic benefit, the heat transfer resistance may also be increased. Moreover, in contrast to conventional spacers, there are volumes available between the first and second wall segments for accommodating desiccant, whereby the capacity for absorbing water vapor out of the interspace between the panes may be increased.

In an embodiment with chamfered end regions of the first and second side wall, the first and second wall segments of the outer wall are each connected to the chamfered end region of the first and second side wall, respectively.

The first and second wall segments of the outer wall increase the dimensional stability of the spacer in longitudinal direction and facilitate the handling during the manufacture of the frame. The first and second wall segments of the outer wall are configured, moreover, to specify the geometry of the spacer on the side pointing away from the interspace between the panes and to support the vapor diffusion barrier.

In accordance with a second variant of this embodiment, the spacer in accordance with the invention comprises an integrally formed outer wall, which extends substantially in parallel to the inner wall from the optionally chamfered end region of the first side wall to the optionally chamfered end region of the second side wall. In this second variant, the outer wall has a multitude of regularly arranged through holes, which have a round, oval, or polygonal free cross section. Also in this second variant, the cavity is closed in cross section only by applying the vapor diffusion barrier.

This second variant with an integrally formed outer wall with regularly arranged through holes has the advantage that, firstly, the rigidity of the spacer is further increased compared to the first variant with a side wall formed in two parts. In particular, the torsional stiffness of the spacer along the longitudinal direction of the spacer is then increased compared to the first variant. Secondly, the heat conduction from the first to the second side wall remains at a low level due to the through holes, because the path that the heat must travel is extended. Moreover, additional desiccant can be accommodated in the volume remaining free due to the through holes, wherein the capacity for the absorption of water vapor out of the interspace between the panes may be increased.

The through holes have in particular a free cross sectional area of about 30% to about 80% with respect to the total surface area of the integrally formed outer wall.

The through holes of the outer wall are preferably arranged in two or more parallel rows. In the case that the through holes are formed to be slit-shaped, their longitudinal direction is preferably aligned in parallel to the longitudinal direction of the spacer. The slit-shaped through holes, which are preferably arranged in two or more parallel rows, are further preferably arranged offset from each other, seen in longitudinal direction of the spacer. This has the advantage that the path that the heat has to travel from one glass pane to the other is extended. The heat conduction may thus be reduced.

In a further embodiment, the through holes are preferably configured in the form of periodically arranged triangles. The triangular through holes may be formed symmetrically perpendicular to the longitudinal direction of the spacer. A vertex of a triangle points alternatingly to the first and to the second side wall and a side of a triangle subtending the vertex is preferably aligned substantially in parallel to the longitudinal direction of the spacer.

The outer wall is preferably produced using the same material, further preferably produced integrally with the side walls, and is preferably produced integrally with the side walls and optionally with the inner wall of the profile body.

In both variants of the outer wall, the vapor diffusion barrier is optionally arranged externally abutting the outer wall. This has the advantage that the vapor diffusion barrier made of a sheet material may be supported by the outer wall.

The vapor diffusion barrier is made of a sheet material. The sheet material is preferably selected from a single or multilayer polymer film. The polymer film is preferably a thermoplastic polymer film, a thermoset polymer film, and/or an elastomeric polymer film. The thermoplastic, thermoset, and elastomeric polymer film, respectively, is in particular crosslinked. The polymer of the polymer film may be the same as or different from the polymer of the first plastics material.

In an alternative embodiment, the vapor diffusion barrier made of a sheet material is produced from an ultrathin glass tape.

Ultrathin in the context of the description of the invention means that the glass tape preferably has a thickness of less than about 150 μm.

Unlike in vapor diffusion barriers made of full-metal metal foils, the heat transfer resistance in the spacer in accordance with the invention is not—or hardly—diminished by the vapor diffusion barrier made of a poorly heat conducting material.

The vapor diffusion barrier is preferably materially bonded to the side walls. This has the advantage that the tightness against moisture and water vapor, respectively, may thus be optimized. If the vapor diffusion barrier is materially bonded to the optional outer wall, a mechanical stabilization of the vapor diffusion barrier is achieved.

The vapor diffusion barrier preferably comprises a stiffening element, wherein the stiffening element in particular comprises a mesh with fibers for improving the torsional rigidity. The torsional rigidity describes the resistance of a component against twisting and torsion, respectively. An increased torsional rigidity of the spacer in accordance with the invention has the advantage that the spacer in accordance with the invention is easy to handle during the production of the frame, and even if no outer wall is provided.

The fibers of the mesh may in particular be aligned at an angle of about 45° and about 135°, respectively, to the longitudinal direction of the spacer. The shear stiffness of the outer wall reinforced with mesh, which is increased as a result, increases the torsional rigidity of the spacer. This has the advantage that the resistance of the spacer against twisting is increased.

Upon manufacture of the vapor diffusion barrier of the spacer in accordance with the invention, various concepts can be implemented, in accordance with which the sheet material of the vapor diffusion barrier may be formed.

In a first preferred embodiment, the vapor diffusion barrier is made of a polymer film. The polymer film preferably has a layer, hereafter also referred to as coating, on its external and optionally on its internal surface, which in particular is formed by metal plating. The tightness against water vapor, in comparison to the tightness of polymer films not formed by metal plating, is increased by the coating formed by metal plating or other alternative coatings described hereinafter.

The external and internal surface of the polymer film, respectively, refers to the installed state in the spacer. The external surface of the polymer film is arranged pointing away from the interior of the cavity formed by the spacer and toward the sealant. The interior surface of the polymer film is arranged pointing toward the interior of the cavity formed by the spacer and away from the sealant.

In some embodiments, the layer or coating, as mentioned above, is made of alternative materials. Thus, coatings made of $Si_xO_y$, $Al_xO_y$, $TiO_y$, $Sn_xO_y$ or graphene are also preferred coatings, which are configured to have the same advantages regarding the water vapor-tightness as coatings formed by metal plating.

The coating formed by metal plating is preferably made of aluminum.

A layer of aluminum formed by metal plating has the advantage that aluminum is light in comparison to other metals and the weight of the vapor diffusion barrier may be kept low. Moreover, aluminum is able to be processed easily and is able to be applied in thin layers, for example by sputtering.

The coating formed by metal plating preferably at least partially comprises a metal oxide layer, which arose by way of surface oxidation of the coating formed by metal plating caused by air or an oxygenic atmosphere. This surface oxidation of the coating formed by metal plating has in particular a composition of $Me_aO_b$, wherein Me stands for a metal used in the coating formed by metal plating, for example $Al_xO_y$. The indices a, b, x, y represent whole numbers and are determined by a stoichiometric composition resulting from the chemical structure.

The at least partial surface oxidation has the advantage that the polymer film may be lastingly stored, because the at least partial surface oxidation of the coating formed by metal plating creates a protection against possible corrosion.

A layer and coating, respectively, on the external surface of the polymer film has the advantage that it improves the adhesion to typically used sealants.

Vapor diffusion barriers made of polymer films that are completely coated with oxides are also used in the prior art (for example in DE 198 07 545 A1 and in WO 2013/104507 A1).

The inventors have surprisingly found, though, that a polymer film having a partial $Al_xO_y$ layer is configured to already yield a long-lasting bondability to conventionally used sealants, while the bondability of a $SiO_2$-like layer to the sealants decreases over time.

The polymer film preferably has a multilayered structure and comprises one or more layers which have a coating on one or both sides.

In particular, multiple coatings, in particular also coatings formed by metal plating, may improve the vapor-tightness, while a minimized heat conductivity may be ensured with the layers made of a polymer material between the coatings. The reduction of the total heat transfer resistance due to the vapor diffusion barrier may be overall minimized due to the small amount of metal.

In contrast to the prior art, which discloses an alternating arrangement of metal layers and polymer layers seen in a cross section perpendicular to the longitudinal direction of the spacer, it is advantageous for the purposes of the invention if, in a multilayer, preferably a three-layer structure of the polymer film, adjoinment or abutment occurs at least in one instance in the coatings or layers, in particular coatings formed by metal plating. Adjoinment preferably occurs at least in one instance in the coatings, in particular in the form of coatings formed by metal plating.

In the case of adjoining or abutting coatings formed by metal plating, the probability is minimal that two gas-permeable voids in the various layers overlap. Thus, the probability is drastically minimized that gas molecules on a direct path through overlapping voids pass through both adjoining coatings formed by metal plating and the barrier effect is maximal. Hence, the principle of the "Tortuous Path" is realized.

Gas-permeable voids in a coating formed by metal plating are preferably substantially closed and/or adequately sealed by the adjoining or abutting coating formed by metal plating, in such a way that the passage of gas molecules through the voids is reduced in comparison to non-adjoining coatings formed by metal plating.

The advantages stated in conjunction with the adjoining or abutting coatings formed by metal plating apply equally to alternative coatings or layers.

For the purposes of the invention, various structures of the polymer film are conceivable. In a three-layer structure having a middle and two outer layers, the middle layer preferably has a single-sided coating, in particular in the form of a coating formed by metal plating. The outer layers preferably have a coating on both sides, in particular in the form of coatings formed by metal plating.

Alternatively, for the purposes of the invention that, in a three-layer structure of the polymer film, all three layers may have a coating on both sides, in particular in the form of coatings formed by metal plating.

The individual layers of the polymer film that, as previously described, have coatings, in particular in the form of coatings formed by metal plating, are preferably materially bonded to each other with a layer of adhesive. The layer of adhesive preferably has a thickness of about 4 μm or less, in particular a thickness of about 3 μm or less.

The polymer film and/or the individual layers of the polymer film preferably has/have a thickness in the range of about 5 μm to about 150 μm, preferably of about 5 μm to about 60 μm. In particular the thickness is in the range of about 10 μm to about 60 μm. A thickness of about 5 μm is often sufficient so that the polymer film is firm enough to be able to be easily handled, while a thickness of about 150 μm, in particular of about 60 μm, is still thin enough so that the polymer film is sufficiently flexible for processing. With regard to the applicability, a polymer film having a thickness of up to about 60 μm is particularly advantageous.

A coating formed by metal plating preferably has a thickness in the range of about 20 nm to about 180 nm. A thickness of about 20 nm is sufficient so that the layer is adequately tight and thus securely seals against vapor diffusion, while in the case of a thickness of about 180 nm, still so little material is applied, even in the case of metal, that the contribution of the vapor diffusion barrier to the heat conductivity remains sufficiently small.

The sum of all coatings formed by metal plating is preferably less than 1 μm. This has the advantage that the decrease in total heat transfer resistance due to the contribution of the vapor diffusion barrier is minimal.

The stated preferred thicknesses and sums thereof apply likewise to the thicknesses of alternative coatings.

The polymer film and/or the layers of the polymer film is/are preferably made of polyester, in particular polyethylene terephthalate (PET) and/or polybutylene terephthalate (PBT), polyolefin, in particular polyethylene (PE) and/or polypropylene (PP), cyclo-olefin copolymers (COC), polyether, polyketone, polyurethane, polycarbonate, vinyl polymer, in particular polystyrene (PS), polyvinyl fluoride (PVDF), ethylene vinyl alcohol (EVOH) and/or polyvinyl chloride (PVC), polyamide (PA), silicone, polyacrylonitrile, polymethylmethacrylate (PMMA), polyhalogen olefin, in particular polychlorotrifluoroethylene (PCTFE) and/or polytetrafluoroethylene (PTFE), liquid crystalline polymer, and blends of these materials.

In a second preferred embodiment, the vapor diffusion barrier is made of an ultrathin glass tape.

The ultrathin glass tape preferably has a thickness of about 100 μm or less. A glass tape with a thickness of about 100 μm or less is sufficiently flexible in order to have a reduced susceptibility to breaking when processing the spacer to a frame.

The ultrathin glass tape particularly preferably has a thickness of about 25 μm to about 100 μm. A thickness of about 25 μm already suffices in order to be able to handle the glass tape in production, while an ultrathin glass tape having a thickness of about 100 μm is still sufficiently flexible for processing the spacer to a frame.

Unlike in the prior art, the ultrathin glass tape is preferably used as a vapor diffusion barrier without the need to be supported by an integral outer wall made of plastics.

The ultrathin glass tape may optionally be applied to the profile body together with an adhesive film.

The ultrathin glass tape is likewise configured to be sufficiently supported by the chamfered end regions of the first and second side wall and by the first and second wall segments of the outer wall, respectively. Thus, its poorly heat conducting characteristics may be utilized without a support of the ultrathin glass tape by way of an outer wall closed throughout and thus an increased material usage being necessary.

In embodiments in which the vapor diffusion barrier is made of an ultrathin glass tape, the vapor diffusion barrier and the glass panes of the insulating glass pane may be produced of the same type of material. As a result, the selection of a suitable sealant for bonding the spacer and the glass panes is made easier. This has the advantage that the adhesion of the exterior spacer surface to the sealant is improved.

Due to the extremely small thickness of the ultrathin glass tape, it bears the stress of a possible bending better than a thicker glass tape. Thus, an initially planar ultrathin glass tape can be fitted to the shape of the spacer without breaking. A planar ultrathin glass tape having a thickness of about 25 μm possesses, for example, a minimum bend radius of about 2 to 3 mm. This minimum bend radius defined on the inside of the bending point specifies with what minimum radius a workpiece may be bent without breaking or cracking.

The ultrathin glass band particularly preferably has a minimum bend radius of about 5 mm to about 8 mm.

The side walls in the interior of the profile body in regions in which the side walls change over into the chamfered end regions preferably have an increased wall thickness to match the geometry to conventional corner connectors. The modification of the wall strength in regions of the side wall has the advantage that the spacer is, on the one hand, stabilized and is configured to better accommodate corner connectors for processing in a frame, and, on the other hand, the heat transfer resistance remains substantially unaffected.

The profile body preferably has ribs in the interior on the side walls and/or on the outer wall. The ribs also enable a matching to the form of existing corner connectors, such that the corner connectors, in particular also in embodiments that also have an increased wall thickness of the side walls, may be held in a press fit in the cavity of the spacer in accordance with the invention.

For the formation of articulation areas, the profile body preferably has a reduced wall thickness in wall regions in which the integral outer wall connects to the first and second side wall, respectively, or in which the first and second wall segments of the outer wall connect to the first and second side wall, respectively, and/or in the side walls adjacent to their chamfered end regions. The wall regions formed as articulation areas are preferably formed as grooves in the interior of the profile body. This has the advantage that the preferably trapezoidal geometry of the spacer in cross section perpendicular to the longitudinal direction also may be obtained, even at the corners, when bending the spacer in accordance with the invention to a frame.

In particular, the wall regions formed as articulation areas are preferably formed as grooves in the interior of the profile body. This has the advantage that the side walls of the spacer in accordance with the invention do not have to tilt toward the interior of the profile body when bending the spacer, and so the side walls are also sufficiently planar in the corners of the spacer, in order to be able to remain in contact with the glass panes in the mounted state of the insulating glass pane.

Moreover, the heat transfer resistance of the spacer may be increased by the formation of the articulation areas.

A first and a second reinforcing element is preferably arranged in the inner wall in parallel to the longitudinal direction of the spacer profile, wherein the first reinforcing element is arranged in a first segment of the inner wall adjacent to the first side wall, and wherein the second reinforcing element is arranged in a second segment of the inner wall adjacent to the second side wall. This has the advantage that the longitudinal stiffness of the spacer may be increased and the spacer in accordance with the invention may be more easily processed to a frame.

The reinforcing elements preferably have a spacing from the respective side walls that corresponds to about 5 to about 40%, preferably about 10 to about 30%, of the distance between the side walls. In these positions, the stabilization of the spacer may be maximized by the reinforcing elements.

In particular, the reinforcing elements are formed to be wire-shaped, also optionally formed as flat wire.

Wires are often made of a metal with comparatively high heat conductivity. The use of wires in comparison to sheets may minimize the reduction of the heat transfer resistance due to the reinforcing elements, because wires typically have a smaller extension in the direction of the heat conduction than sheets.

The inner wall in the region of the reinforcing elements preferably has projections extending in the direction of the cavity formed by the spacer, the regions having a greater wall thickness than the adjacent regions of the inner wall. The greater wall thickness preferably corresponds to about the sum of the thickness of the reinforcing elements, measured perpendicularly to the surface of the inner wall, and of the thickness of the adjacent regions of the inner wall. The projections are substantially matched to the contour of the reinforcing elements. This has the advantage that even reinforcing elements with greater diameters may be embedded into the inner wall and securely anchored. The regions of the inner wall with greater wall thicknesses are configured to provide the spacer with additional stability. This embodiment further has the advantage that the spacer is configured to be more easily bent into corner regions. The risk that the first and second reinforcing elements in the interior of the profile body come out of the plastics material upon bending may be minimized in this embodiment.

The wall segments of the outer wall (where provided) in the regions aligned in parallel to the inner wall, which are opposite the regions of the inner wall that accommodate the reinforcing elements, preferably have a recess that in particular is formed in each case complementary to the projections of the inner wall, and that preferably corresponds to half of the thickness of the reinforcing elements and/or corresponds to the contour of the projections. This has the advantage, firstly, that material may be saved and, secondly, that the heat transfer resistance may be increased. Moreover, the spacer is configured to be bent better at the corner regions when producing the frame.

The first plastics material of the profile body is preferably based on polyolefin, in particular polypropylene (PP), polycarbonate (PC), polyvinyl chloride (PVC), styrene-acrylonitrile-copolymer (SAN), polyphenylene ether (PPE), polyester, in particular polyethylene terephthalate (PET), polyamide (PA), and/or acrylonitrile butadiene styrene copolymer (ABS), and blends of these materials.

This has the advantage that the spacer in accordance with the invention is configured to be easily processed to a frame by bending or welding. Moreover, it is configured to have an optimized impact resistance under mechanical load.

The first plastics material in accordance with a first variant preferably has an amount of reinforcing fibers of about 1% by weight to about 80% by weight, in particular an amount of about 30% by weight to about 50% by weight. This has the advantage that the rigidity of the spacer may be increased and spacers having smaller wall thicknesses may be manufactured that have a sufficient rigidity with reduced material usage. Furthermore, the spacer having reinforcing fibers is configured to be easily processed by welding.

Preferably fibers in the form of polymer fibers, carbon fibers, and/or fibers made of inorganic materials are used as reinforcing fibers.

Polymer fibers are preferably made of thermoplastic polymers like, for example, Plexiglas, polyolefin, polyamide, and polyester and/or fibers made of non-melting polymers like, for example, non-melting polyamides, in particular aramids (e.g. Kevlar®). For increasing the stiffness, the fibers made of thermoplastic polymers may be oriented lengthwise and thereby strengthened.

Fibers made of inorganic materials are preferably made of metal fibers, for example steel fibers and/or glass fibers, in particular long glass fibers. Mineral fibers, ceramic fibers, basalt fibers, boron fibers, and/or silicic acid fibers may also be used as inorganic fibers, however.

The fibers are preferably present as individual fibers, fiber strands (rovings), felts, woven fabrics, knitted fabrics, and/or layered fabrics.

In embodiments with fiber strands, the fiber strands are preferably arranged symmetrically in the outer wall and the inner wall of the spacer. The use of fiber strands, also so-called rovings, has the advantage that the longitudinal stiffness and the torsional rigidity of the spacer may be increased.

Furthermore, the reinforcing elements in the outer wall are configured to be inserted in the form of loops/arcs or in a zig-zag pattern. This has the advantage that the reinforcing elements further increase the torsional rigidity of the spacer. Alternatively, the reinforcing elements may be incorporated not into the wall, but rather, when affixing the vapor diffusion barrier, be bonded between it and the profile body.

In accordance with an alternative embodiment of the spacer in accordance with the invention that has fiber strands, the profile body is preferably formed free of further reinforcing fibers. This has the advantage that the weight of the spacer may be reduced in comparison to an embodiment with additional reinforcing fibers and that the heat transfer resistance may be improved.

Optionally, in the case of a sufficient mechanical stiffness of the profile body, reinforcing fibers, in particular glass fibers, may also be forgone.

In an embodiment with wire-shaped reinforcing elements, the spacer is preferably formed free of reinforcing fibers. The stiffness that may be generated in the other embodiments can, in this embodiment, be provided by way of the reinforcing elements.

The first plastics material preferably has natural fibers as filling material. In particular, coir, hemp fibers, sisal fibers, wood fibers, and/or flax fibers are used here. Natural fibers serve less for the strengthening of the spacer, but rather may enable a greater heat transfer resistance in comparison to plastics materials without natural fibers. Moreover, plastics material may be reduced in this embodiment. An especially ecological manufacture of the spacer is also achievable using natural fibers.

However, natural fibers, for example made of coir, hemp, sisal, wood, or flax, may also be used as reinforcing fibers.

A further possibility to ensure the ecological manufacture of the spacer in accordance with the invention may be achieved in an embodiment in which recyclate, in particular from polycarbonate and/or polyester, in particular PET, is preferably used as a first plastics material, and/or in which the spacer is made of a biodegradable polymer material, in particular low-molecular polyamide. Recyclates are, for the purposes of the description of the invention, plastics materials which have already been processed at least once, which were recovered in a recycling process.

Spacers may preferably have an inner wall that, compared with the wall thickness of the projections, has a reduced thickness in regions directly adjacent to the side walls. Also these regions with reduced wall thickness form articulation areas that, upon compressive loading of the spacer when bending the corners of the frame, are configured to counteract a deformation of the side walls and thereby counteract a reduced contact area on the glass panes.

This applies especially if first and second reinforcing elements are arranged in the inner wall.

The profile body is preferably formed having pores, in particular with closed pores, at least in portions of the inner and side walls and optionally of the outer wall. Thus, the weight of the spacer may be reduced and its heat transfer resistance increased.

The first plastics material preferably comprises additives, in particular selected from fillers, pigments, light stabilizers, impact resistance modifiers, antistatic agents, and/or flame retardants. This has the advantage, firstly, that the appearance of the spacer in accordance with the invention may be optimized and, secondly, that its characteristics may be adapted to the specific requirements.

A further aspect of the present invention relates to a method for producing a spacer in accordance with the invention, comprising providing the profile body which has a main body with a substantially U-shaped cross section, providing the vapor diffusion barrier, aligning the vapor diffusion barrier to the longitudinal direction of the profile body, and connecting the vapor diffusion barrier to the side walls and optionally to the outer wall of the profile body.

The vapor diffusion barrier made of a sheet material, in particular selected from a polymer film and an ultrathin glass tape, may be provided coiled on a spool in a planar form, in particular as continuous material.

The vapor diffusion barrier is bonded to the side walls of the profile body and optionally to the outer wall. Preferably, a layer of adhesive is first applied to the side walls and, as the case may be, to the outer wall for bonding the vapor diffusion barrier to the profile body. The layer of adhesive has the advantage that it is configured to produce a material bond between profile body and vapor diffusion barrier.

Preferably, in accordance with a further variant, an ultrathin glass tape is used as a vapor diffusion barrier.

Before being connected to the profile body, the ultrathin glass tape is heated to a shaping temperature. The shaping temperature is preferably selected such that the glass tape is plastically shapeable.

In particular, the glass tape is heated to a temperature in the range of about 350° C. to about 550° C. before it is subject to shaping. A temperature of about 350° C. suffices to make the ultrathin glass tape shapeable, while the viscosity of the ultrathin glass tape is still low enough to be able to carry out the shaping plastically.

Using a shaping tool, the ultrathin glass tape is preferably made substantially U-shaped at a temperature in the range of the shaping temperature, wherein the U-shape comprises a middle segment and two attaching rim segments. The rim segments are arranged spaced substantially in parallel to each other.

The shaping tool is preferably made of multiple pairs of rollers, wherein the glass tape is made substantially U-shaped by being drawn through these pairs of rollers.

The shaping tool is preferably heated such that the temperature of the shaping tool is in the range of about 350° C. to about 550° C.

The temperature of the shaping tool is preferably maintained at about 350° C. or more during the shaping. Thus, a premature solidification of the ultrathin glass tape is prevented.

The temperature of the shaping tool is preferably not more than about 550° C. during the shaping of the ultrathin glass tape, such that the ultrathin glass tape is still plastically deformable and does not form a viscous mass.

The compliance of the form of the shaped ultrathin glass tape with parts of the contour of the profile body enables the connection in a mechanically substantially tension-free state of the glass tape.

The ultrathin glass tape is applied in the heated state tension-free from the exterior to the side walls and optionally from the exterior to the outer wall of the profile body.

If a planar glass tape were to be attached to the profile body by elastic deformation in the cold state, forces would act on the ultrathin glass tape after being connected. By shaping the glass tape, these forces in the ultrathin glass tape may be at least drastically reduced and the ultrathin glass tape may be applied substantially tension-free.

Moreover, the risk that the ultrathin glass tape detaches from the profile body due to forces acting on it may be minimized by the shaping.

After shaping, the ultrathin glass tape is cooled down to about 20 to about 50° C.

After the ultrathin glass tape cools down, the ultrathin glass tape permanently has the U-shape previously described with two rim segments arranged substantially in parallel to each other and with a middle segment which facilitates the connection to the profile body.

Before being applied to the profile body, the shaped U-shaped ultrathin glass tape is elastically deformed, wherein the parallel rim segments are elastically bent away from each other.

After shaping, the ultrathin glass tape has a cross section that corresponds to parts of the contour of the profile body. By elastically deforming the U-shape, it may be avoided that the rim segments of the ultrathin glass tape in cross section perpendicular to the longitudinal direction are at the same distance from each other as the outer sides of the side walls of the profile body. It may thus be avoided that shear forces arise, which would arise if the rim segments of the non-deformed glass tape were to be pushed over the side walls, to which a layer of adhesive has optionally applied, and optionally over the outer wall. Without these shear forces, connecting the ultrathin glass tape to the profile body is made easier.

The elastically deformed glass tape is positioned on the profile body which has optionally been provided with a layer of adhesive, in such a way that the rim segments each abut the first and second side wall, respectively, or the middle portion abuts the outer wall, as the case may be.

By elastically deforming the ultrathin glass tape, the rim segments of the ultrathin glass tape abut the corresponding surfaces of the profile body upon being returned to the U-shape, without shear stress the optionally present layer of adhesive occurring.

The elastically deformed ultrathin glass tape is returned to its U-shape after being positioned on the profile body, wherein the rim segments abut the side walls in a substantially stress-free state and the middle part optionally abuts the outer wall.

BRIEF DESCRIPTION OF THE SEVERAL VIEWS OF THE DRAWINGS

These and further advantages of the invention are discussed in more detail below by way of the drawings. They show in detail.

DETAILED DESCRIPTION OF THE DRAWINGS

Figure 1:
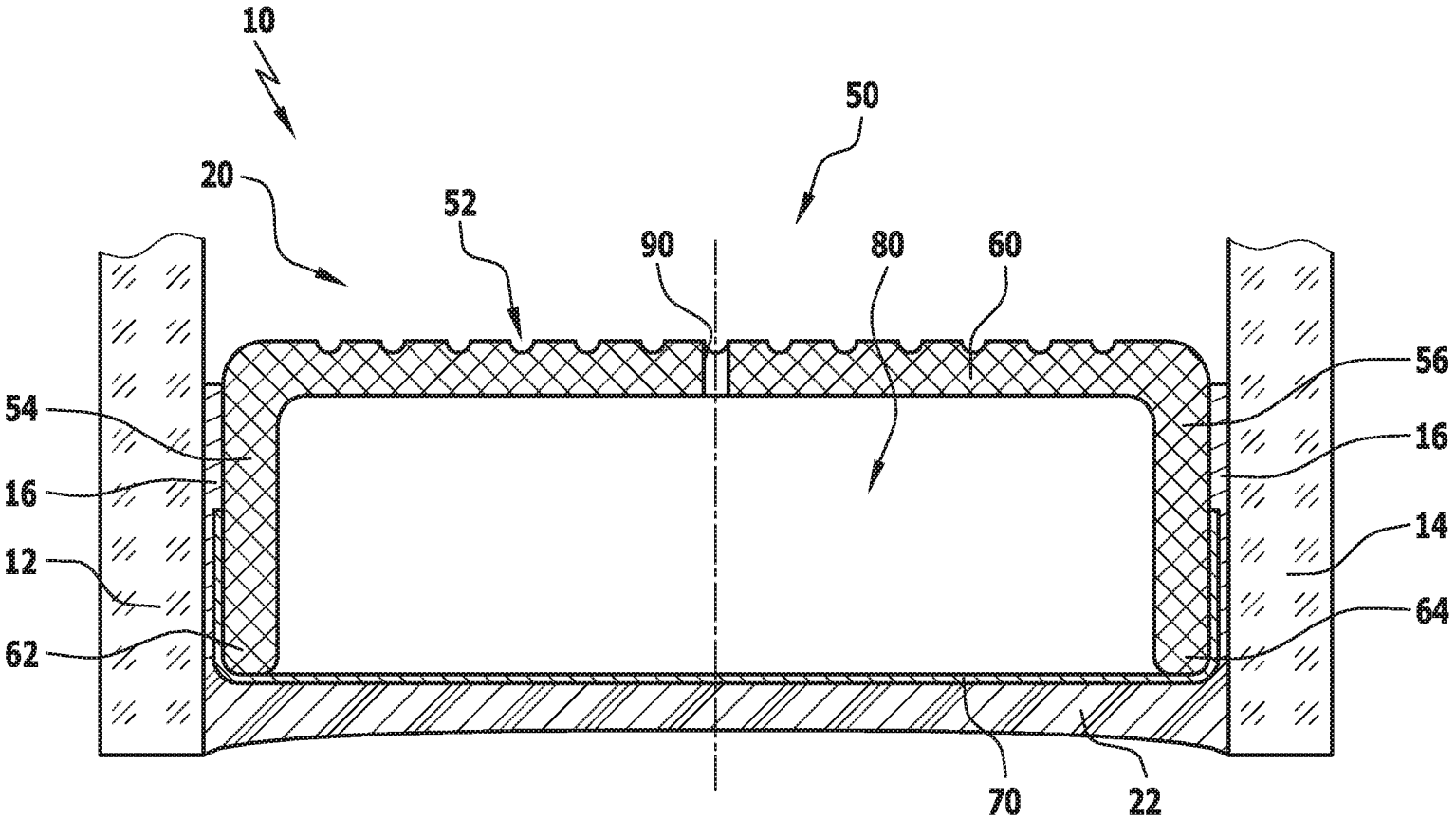
FIG. 1: a first embodiment of a spacer in accordance with the invention in its installation situation in an insulating glass pane.

FIG. 1 shows a rim segment of an insulating glass pane 10 having a first and a second glass pane 12, 14 and a spacer 50 in accordance with the invention that holds the panes 12, 14 spaced apart in a cross section perpendicular to the longitudinal direction of the spacer 50.

The first and second glass panes 12, 14 are bonded to the spacer 50 by means of a primary butyl sealant 16. In the installed state, the glass panes 12, 14 and the spacer 50 bent to a frame enclose an interspace 20 between the panes, of which only a section is shown here.

The spacer 50 in accordance with the invention comprises a profile body 52 made of a first plastics material, which has a main body with a substantially U-shaped cross section. The profile body 52 is typically integrally produced in an extrusion process. In the present case, the profile body 52 is made of polypropylene (PP), in particular a polypropylene homopolymer.

The first plastics material preferably comprises hemp fibers. Natural fibers in the form of hemp fibers are configured to increase the heat transfer resistance in comparison to plastics materials without natural fibers.

The profile body 52 comprises first and second side walls 54, 56 arranged in parallel to each other, and an inner wall 60 extending from the first side wall 54 to the second side wall 56. The first and the second side wall 54, 56 each have a free end 62, 64 spaced apart from the inner wall 60.

The spacer 50 further comprises a vapor diffusion barrier 70 which is made of a poorly heat conducting sheet material and which extends from the first side wall 54, its free end 62, over the free end 64, to the second side wall 56. The vapor diffusion barrier 70 extends substantially in parallel to the inner wall 60 in the region between the free ends 62, 64 of the side walls 54, 56, at a specified spacing from the side walls 54, 56.

The poorly heat conducting sheet material of which the vapor diffusion barrier 70 is made is different from the first plastics material.

It is also conceivable for the purposes of the invention that the poorly heat conducting sheet material of the vapor diffusion barrier 70 is substantially identical to the first plastics material of the profile body 52.

Finally, between the glass panes 12, 14, a secondary sealant 22 is applied on the outer side of the vapor diffusion barrier 70.

The spacer 50 has a cavity 80 that is enclosed by the profile body 52 and the vapor diffusion barrier 70. On the side opposite the inner wall 60, the cavity 80 is delimited only by the vapor diffusion barrier 70.

The cavity 80 is connected to the interspace 20 between the panes via perforation openings 90 in the inner wall 60.

The cavity 80 in the assembled state may be filled with desiccant (not shown), which may absorb water vapor or moisture out of the interspace 20 between the panes via perforation openings 90.

Figure 2:
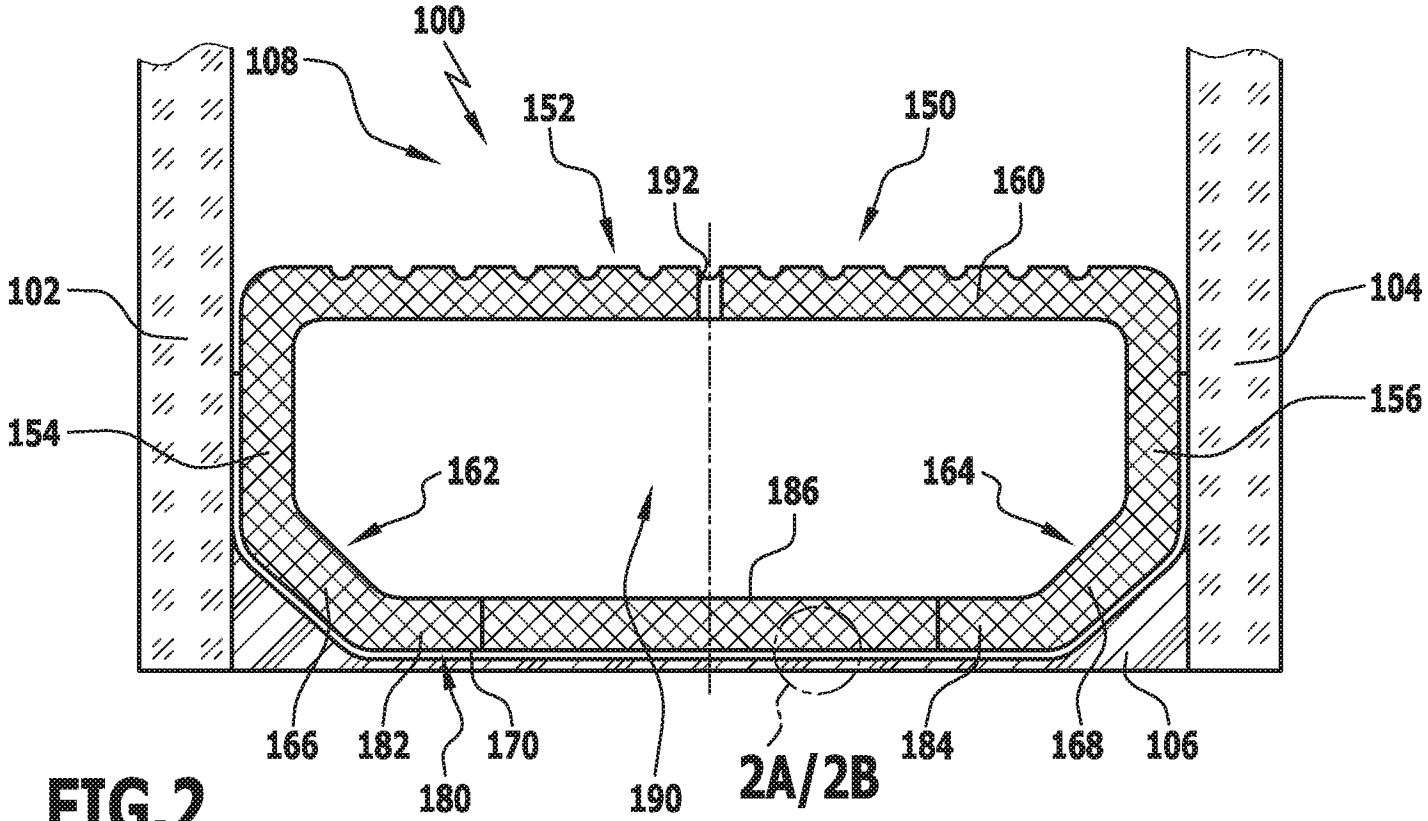
FIG. 2: a second embodiment of a spacer in accordance with the invention in its installation situation in an insulating glass pane.

FIG. 2 shows a further spacer 150 in accordance with the invention in the installed state in an insulating glass pane 100. The insulating glass pane 100 is shown in a cross section perpendicular to the longitudinal direction of the spacer 150. The depicted insulating glass pane 100 comprises a first and a second glass pane 102, 104 in addition to the spacer 150 in accordance with the invention.

The glass panes 102, 104 are bonded to the spacer 150 using a primary sealant (not shown). The spacer 150 bent to a frame and the glass panes 102, 104 enclose, in the assembled state of the insulating glass pane 100, an interspace 108 between the panes, which is only partially shown here.

The spacer 150 comprises a profile body 152 made using a first plastics material, the profile body 152 having a main body with a substantially U-shaped cross section.

The profile body 152 comprises a first and a second side wall 154, 156 that are arranged in parallel to each other, and an inner wall 160 extending from the first side wall 154 to the second side wall 156. The first and the second side walls 154, 156 each have, spaced apart from the inner wall, a free end 162, 164 having a chamfered end region 166, 168.

The profile body 152 is typically produced integrally in an extrusion process.

The chamfered end regions 166, 168 are aligned inclined toward each other and spaced apart from each other. In the present case, the chamfered end regions 166, 168 of the first and the second side wall 154, 156 are formed at an obtuse angle of about 135° to the respective adjacent side wall 154, 156. The chamfered end regions 166, 168 are presently of planar form.

An approximately triangular volume in cross section, that is configured to accommodate the secondary sealant 106, is created toward the glass panes 102, 104 by the chamfered end regions 166, 168 which, seen in cross section perpendicular to the longitudinal direction of the profile body 152, have an obtuse angle (in the present case about 135°) to the respective adjacent side wall 154, 156 and an acute angle (in the present case about 55°) to the inner wall 160.

The triangular volumes in cross section allow for the realization of significantly larger contact surfaces of the secondary sealant 106 on sides of the glass panes 102, 104 and on sides of the spacer 150, compared to the installation situation of the spacer 50 of the insulating glass pane 10 of FIG. 1, such that a significantly improved sealing of the rim region of the insulating glass pane 100 is achieved.

The spacer 150 further comprises a vapor diffusion barrier 170 that is made of a sheet material and is poorly heat conducting and which extends from the first side wall 154 to the second side wall 156. The vapor diffusion barrier 170 in arranged between the free ends 162, 164 of the side walls 154, 156 substantially in parallel to and spaced apart from the inner wall 160.

Figure 2A:
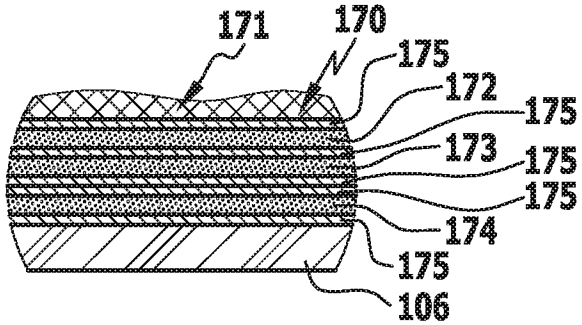
FIG. 2A: a variant of a polymer film as a vapor diffusion barrier of the spacer in accordance with the invention.
Figure 2B:
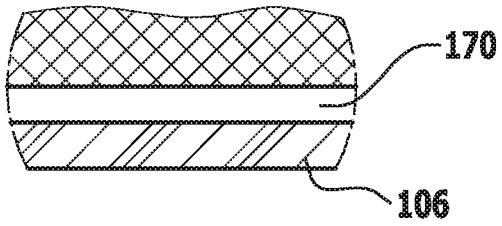
FIG. 2B: a variant of an ultrathin glass tape as a vapor diffusion barrier of the spacer in accordance with the invention.
Figure 2C:
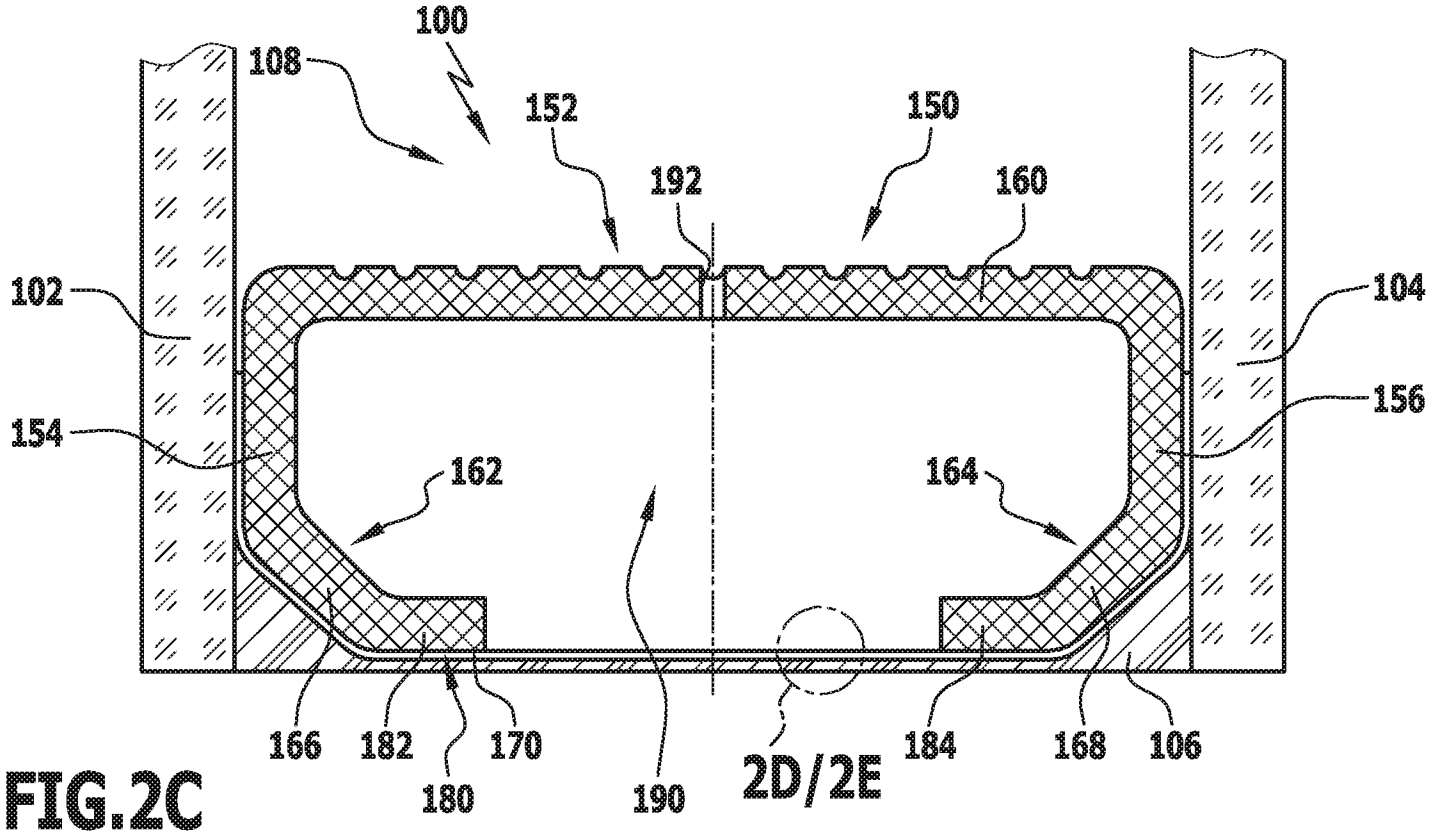
FIG. 2C: a variant of the second embodiment of a spacer in accordance with the invention in its installation situation in an insulating glass pane.

The spacer 150 according to the variant shown in FIG. 2C comprises an outer wall 180 spaced apart from the inner wall 160, wherein the outer wall 180 in a first variant comprises a first and a second wall segment 182, 184 that are arranged in parallel spaced apart from each other. The first and second wall segments 182, 184 are connected to the respective free end 162, 164 of the first and second side wall 154, 156, respectively, and extend away from the respective side wall 154, 156 and toward each other. The first and second wall segments 182, 184 are arranged aligned substantially in parallel to the inner wall 160.

The first and second wall segments 182, 184 presently have substantially the same extension transversely to the longitudinal direction of the spacer 100 and are substantially planar.

Indicated by a line 186 in FIG. 2, a variant with an outer wall 180 is depicted. In this variant, the outer wall 180 is integrally formed and extends from the chamfered end region 166 of the first side wall 154 to the chamfered end region 168 of the second side wall 156. It (the outer wall 180) is arranged substantially in parallel to the inner wall 160.

The outer wall 180 in accordance with this variant has a multitude of regularly arranged through holes (not shown in FIG. 2). Possible variants of the outer wall 180 are depicted in more detail in FIGS. 7A to 7C as well and in FIGS. 8 to FIG. 10.

The vapor diffusion barrier 170 is arranged abutting the outer wall 180 and extends over regions of the side walls 154, 156 and abuts them from the exterior. It (the vapor diffusion barrier 170) is shown in preferred variants in detail in FIGS. 2A, 2B, 2D and 2E.

The profile body 152 together with the vapor diffusion barrier 170 encloses a cavity 190. This cavity 190 is connected to the interspace 108 between the panes via regularly arranged perforation openings 192 in the inner wall 160.

The cavity 190 in the assembled state of the spacer 150 in the insulating glass pane 100 is configured to accommodate desiccant which may bind moisture and water vapor, respectively, out of the interspace 108 between the panes.

The first plastics material, by the use of which the profile body 152 is preferably integrally made, is polypropylene (PP) in the present case and preferably has an amount of glass fibers of 40% by weight. The plastics material is preferably foamed, whereby the increased weight due to the glass fiber amount and the increased heat conductivity due to the glass fiber amount may be compensated. In particular, the first plastics material is formed with closed pores.

Figure 2D:
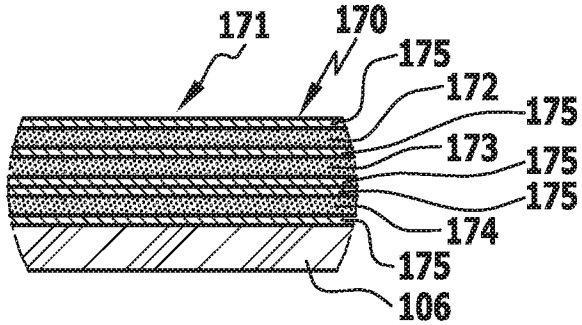
FIG. 2D: a variant of a polymer film as a vapor diffusion barrier of the spacer in accordance with the invention.
Figure 2E:
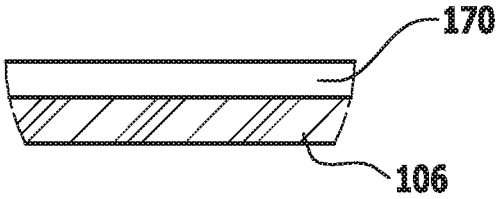
FIG. 2E: a variant of a ultrathin glass tape as a vapor diffusion barrier of the spacer in accordance with the invention.

FIGs. 2A and 2B show, respectively, the portion designated in FIG. 2 by 2A and 2B. FIGS 2D and 2E show, respectively, the portion designed in FIG. 2C by 2E and 2D. FIGS. 2A and 2D show possile variants of a three-layer polymer film 171 as the vapor diffusion barrier 170 of the spacer in accordance with the invention shown in cross section perpendicular to the longitudinal direction of the spacer 150. Also depicted is a sealant 106 by means of which glass panes 102, 104 and spacer 150 are bonded to each other in the installation situation in an insulating glass pane 100 shown in FIGS. 2 and 2C. FIGS. 2B and 2D show an ultrathin glass tape as vapor diffusion barrier 170.

The vapor diffusion barrier 170 is preferably materially bonded to the side walls 154, 156 and to the outer wall 180.

The polymer film 171 has, in the present case, three layers 172, 173, 174, which are each formed of polyethylene terephthalate (PET) having a thickness of about 12 μm. The interior layer 172 of the polymer film 171, which points away from sealant 106, and the exterior layer 174 of the polymer film 171, which points toward sealant 106, each have a coating 175 formed by metal plating on both sides. The interior layer 173 of the polymer film 171 has a coating 175 formed by metal plating on one side. In the present case, the coatings 175 formed by metal plating are made of aluminum and with a thickness of about 80 nm.

Presently, the vapor diffusion barrier 170 made of a poorly heat conducting sheet material is made of a sheet material that is different from the first plastics material.

It is also conceivable for the purposes of the invention that the vapor diffusion barrier 170 or the layers 172, 173, 174 of the vapor diffusion barrier 170 formed as polymer film 171 are made of a sheet material which is substantially identical to the first plastics material of the profile body 152 (presently PP).

Alternatively to polypropylene, the layers 172, 173, 174 of the polymer film 171 and the profile body 152 may be made of polyethylene terephthalate (PET), for example.

The coatings formed by metal plating of the interior layer 173 of the polymer film (middle layer) and of the exterior layer 174 directly adjoin each other in the present case and are optionally connected to each other with a layer of adhesive (not shown).

It is also conceivable for the purposes of the invention that all three layers 172, 173, 174 have a coating 175 formed by metal plating on both sides, in such a way that both between the layer 172, which points away from the sealant, and the interior middle layer 173 of the polymer film 171, and between the layer 174, which points toward the sealant, and the interior middle layer of polymer film 173, two coatings formed by metal plating 175 adjoin or abut each other (not shown).

In the case of adjoining or abutting coatings 175 formed by metal plating, the probability is minimal that two gas-permeable voids in the various layers overlap. As a result, the probability that gas molecules on a direct path through overlapping voids pass through both adjoining coatings 175 formed by metal plating is drastically minimized and the barrier effect of the vapor diffusion barrier 170 is maximal. Hence, the principle of the "Tortuous Path" is achieved.

Moreover, gas-permeable voids in a coating 175 formed by metal plating are in particular closed off or sealed by the adjoining coating formed by metal plating.

The outer coating 175 formed by metal plating of the layer 174, which points toward the secondary sealant 106, enables an improved adhesion between polymer film 171 and sealant 106 in comparison to a polymer film without an exterior coating formed by metal plating.

The outer coating 175 formed by metal plating preferably at least partially has a metal oxide layer (not shown) which creates protection against corrosion and scratches and thus enables a longer storage of the polymer film 171.

The individual layers 172, 173, 174 of the polymer film 171 which, in the present case, have coatings in the form of coatings 175 formed by metal plating are preferably materially bonded to each other with a layer of adhesive (not shown). The layer of adhesive preferably has a thickness of about 4 μm or less, in particular a thickness of about 3 μm or less.

The construction of the vapor diffusion barrier 170 described in FIGS. 2A, 2B, 2D and 2E is also suitable for the vapor diffusion barrier 70 depicted in conjunction with FIG. 1.

Figure 3:
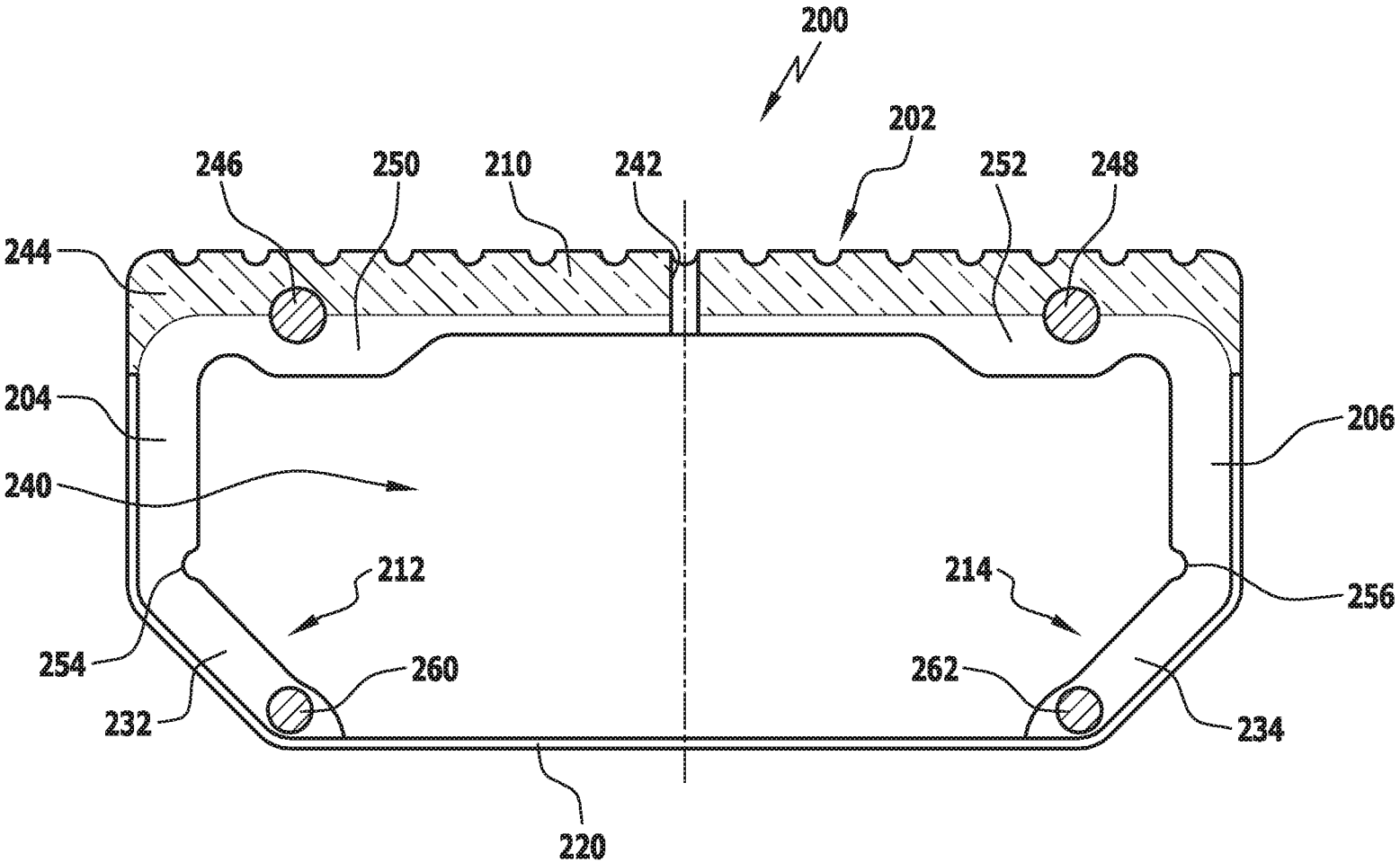
FIG. 3: a further embodiment of a spacer in accordance with the invention.

FIG. 3 shows a further embodiment of a spacer in accordance with the invention in a cross section perpendicular to the longitudinal direction of the spacer 200. The profile body 202 of the spacer 200 comprises first and second side walls 204, 206 arranged in parallel to each other with free ends 212, 214 which have chamfered end regions 232, 234, and an inner wall 210 extending between the first side wall 204 and the second side wall 206.

The chamfered end regions 232, 234 are, as in FIG. 2 (c.f. 166, 168), formed inclined toward each other and have, in the present case, an obtuse angle of about 140° to the respective adjacent side wall 204, 205.

A vapor diffusion barrier 220 made of a sheet material, which is spaced apart from and oriented substantially in parallel to the inner wall 210, extends between the chamfered end regions 232, 234. The vapor diffusion barrier 220 extends over regions of the side walls 204, 206 and over the chamfered end regions 232, 234 attaching to the side walls 204, 206, and abuts them from the exterior.

In the present case, the vapor diffusion barrier 220 is made of an ultrathin glass tape and has a thickness of about 70 μm. It is integrated in a flush manner into the profile body 202 in regions of the side walls 204, 206.

The vapor diffusion barrier 220 made of an ultrathin glass tape preferably has a minimum bending radius of about 7 mm.

The profile body 202 and the vapor diffusion barrier 220 enclose a cavity 240 that, in the installed state in an insulating glass pane (not shown), is configured to accommodate desiccant. The desiccant may absorb water vapor or moisture out of an interspace between the panes (not shown) formed by the spacer processed to a frame and the glass panes, thus enabling a water vapor-free interspace between the panes. The contact between the cavity 240 of the spacer 200 filled with desiccant and the interspace between the panes is provided by perforation openings 242 in the inner wall 210 that are formed in the inner wall 210, regularly arranged along the longitudinal direction of the spacer 200.

A layer 244 of the inner wall 210 of the spacer 200 directed to the interspace between the panes is visible to an observer of the insulating glass pane (not shown). This layer 244 of the profile body 202, which is visible in the interspace between the panes, is preferably made of a pigmented plastics material, in the present case made of a polypropylene (PP)-homopolymer. The rest of the profile body 202 is made of a polypropylene (PP)-copolymer in the present case.

The pigmented layer 244 is typically made with the other parts of the profile body 202 in a coextrusion process. The pigmented layer 244 enables an additional optimization of the appearance of the spacer 200.

Alternatively, in particular the entire profile body 202 may be made of a recyclate, in particular polycarbonate or PET.

The present embodiment of the spacer 200 in accordance with the invention has a first and a second reinforcing element 246, 248. The reinforcing elements 246, 248 are arranged in the inner wall 210 in parallel to the longitudinal direction of the spacer 200.

The first reinforcing element 246 is arranged in a first segment of the inner wall 210, adjacent to the first side wall 204. The second reinforcing element 248 is arranged in a second segment of the inner wall 210, adjacent to the second side wall 206, wherein the reinforcing elements 246, 248 maintain a defined spacing from their midpoint and their geometric center of gravity, respectively, parallel to the inner wall 210 of the respective side wall 204, 206, with respect to a spacing between the first and second side wall 204, 206. The spacing of the reinforcing elements 246, 248 from the respective side wall 204, 206 corresponds, in the present case, to about 15% of the spacing between the side walls 204, 206.

The reinforcing elements 246, 248 are formed wire-shaped and typically have a corrugated surface (not shown). Thus, the adhesion to the plastics material of the profile body 202 is improved and the reinforcing elements 246, 248 may in particular be integrated into the first plastics material in a shear resistant manner.

The inner wall 210 in the region of the reinforcing elements 246, 248 has first and second projections 250, 252 that extend in the direction of the cavity 240 enclosed by the spacer. The risk that the reinforcing elements 246, 248 come out of the profile body 202 during a bending process of the spacer to a frame is minimized by these projections 250, 252.

The profile body 202 in the regions on the side of the cavity 240 in which the chamfered end regions 232, 234 connect to the side walls 204, 206, has articulation areas in the form of grooves 254, 256, which improve the bending properties of the spacer.

For the further improvement of the cold bending properties, further reinforcing elements 260, 262 could optionally be embedded in the chamfered end regions 232, 234 that—optionally with a somewhat smaller diameter—may be formed similarly to the wire-shaped reinforcing elements 246, 248.

Figure 3A:
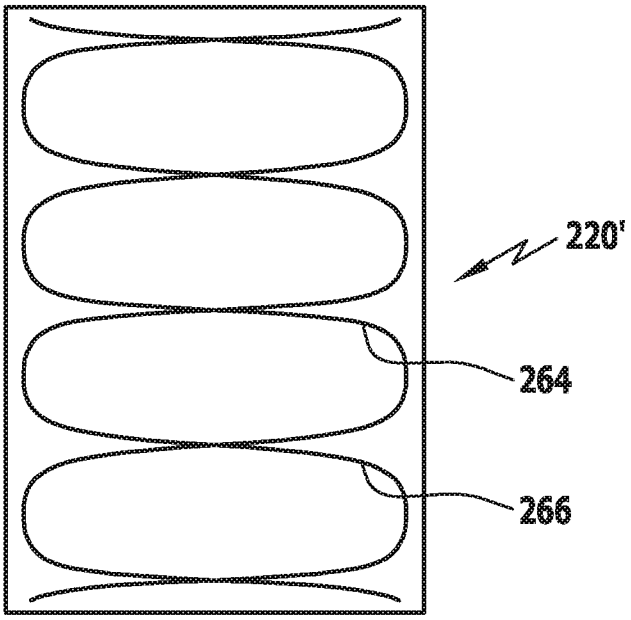
FIGS. 3A and 3B: further variants of the vapor diffusion barrier of a spacer in accordance with the invention.
Figure 3B:
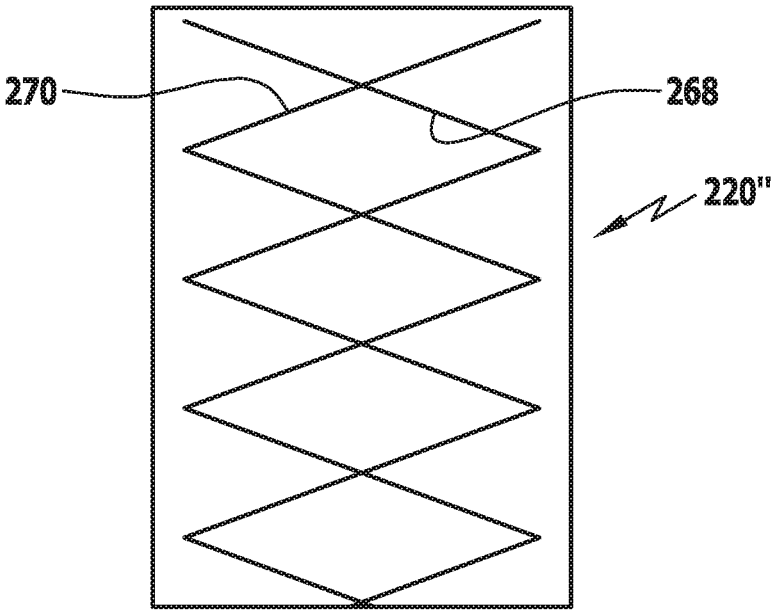

The vapor diffusion barrier 220 may, as shown schematically in FIGS. 3A and 3B, be additionally modified with reinforcing elements 264, 266 and 268, 270, respectively, that are selected from wire materials, glass fiber bundles, rovings etc. that, for example, as shown in FIGS. 3A and 3B by way of the vapor diffusion barrier 220' and 220", respectively, are preferably arranged meandering or in zig-zag pattern on the side of the vapor barrier 220' and 220", respectively, lying toward the cavity. These reinforcing elements 264, 266 and 268, 270, respectively, may typically be bonded onto the surface of the vapor diffusion barrier 220' and 220", respectively.

In particular, the vapor diffusion barrier 220 has a stiffening element which preferably comprises a woven fabric for improving the torsional rigidity (not shown).

Figure 4:
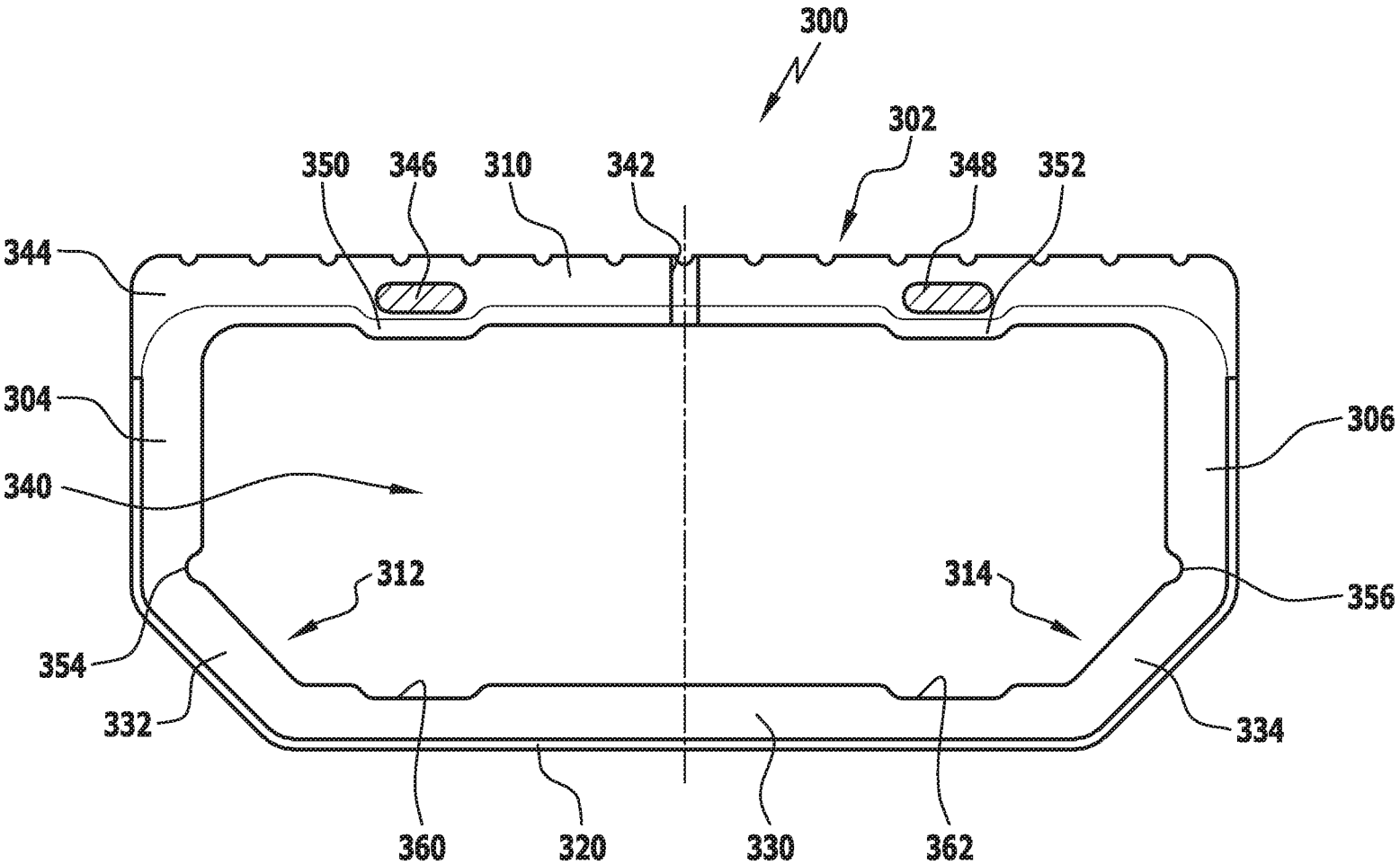
FIG. 4: a further embodiment of a spacer in accordance with the invention.

FIG. 4 shows a further embodiment of a spacer 300 in accordance with the invention in a cross section perpendicular to its longitudinal direction. The spacer 300 comprises a profile body 302 with first and second side walls 304, 306 arranged in parallel, each with a free end 312, 314 having chamfered end regions 332, 334, and an inner wall 310 that extends between the side walls 304, 306.

The spacer 300 further comprises a vapor diffusion barrier 320 that extends from the first side wall 304 over the chamfered end regions 332, 334 to the second side wall 306. The profile body 302 is constructed like the profile body depicted in FIG. 3.

In the present case, the vapor diffusion barrier 320 is made of an ultrathin glass tape and has a thickness of about 30 μm.

The profile body 302 and the vapor diffusion barrier 320 enclose a cavity 340 that, in the installed state of the spacer in an insulating glass pane, communicates via perforation openings 342 in the inner wall 310 with an interspace between the panes formed by glass panes and spacer (not shown). The perforation openings 342 are arranged at regular spacings in longitudinal direction of the spacer 300.

The cavity 340 in the installed state of the spacer 300 in the insulating glass pane preferably accommodates desiccant which may absorb water vapor and/or moisture out of the interspace between the panes of the insulating glass pane. The water vapor and/or the moisture reach the cavity filled 340 with desiccant via the perforation openings 342.

The profile body made of propylene (PP) in the present case is typically produced in an extrusion process. The profile body is preferably foamed and particularly preferably has an amount of long glass fibers of 40% by weight. The plastics material of the profile body 302 is optionally pigmented in a layer 344 visible in the interspace between the panes.

Wire-shaped reinforcing elements 346, 348 formed as flat wire are present in the inner wall 310 in the longitudinal direction of the spacer 300. In the region of the reinforcing elements 346, 348, the inner wall 310 has projections 350, 352 having an increased wall thickness and extending in the direction of the cavity 340.

The greater wall thickness preferably corresponds to about the sum of the thickness of one of the reinforcing elements 346, 348 measured perpendicularly to the surface of the inner wall 310 and to the thickness of the adjacent regions of the inner wall 310.

In regions in which the chamfered end regions 332, 334 connect to the side walls 304, 306, articulation areas in the form of grooves 354, 356 are also formed on the side of the cavity. The grooves reduce a deformation of the side walls 304, 306 when bending the frame to corner regions and thus counteract a reduced contact area between glass panes and spacer 200.

Figure 4A:
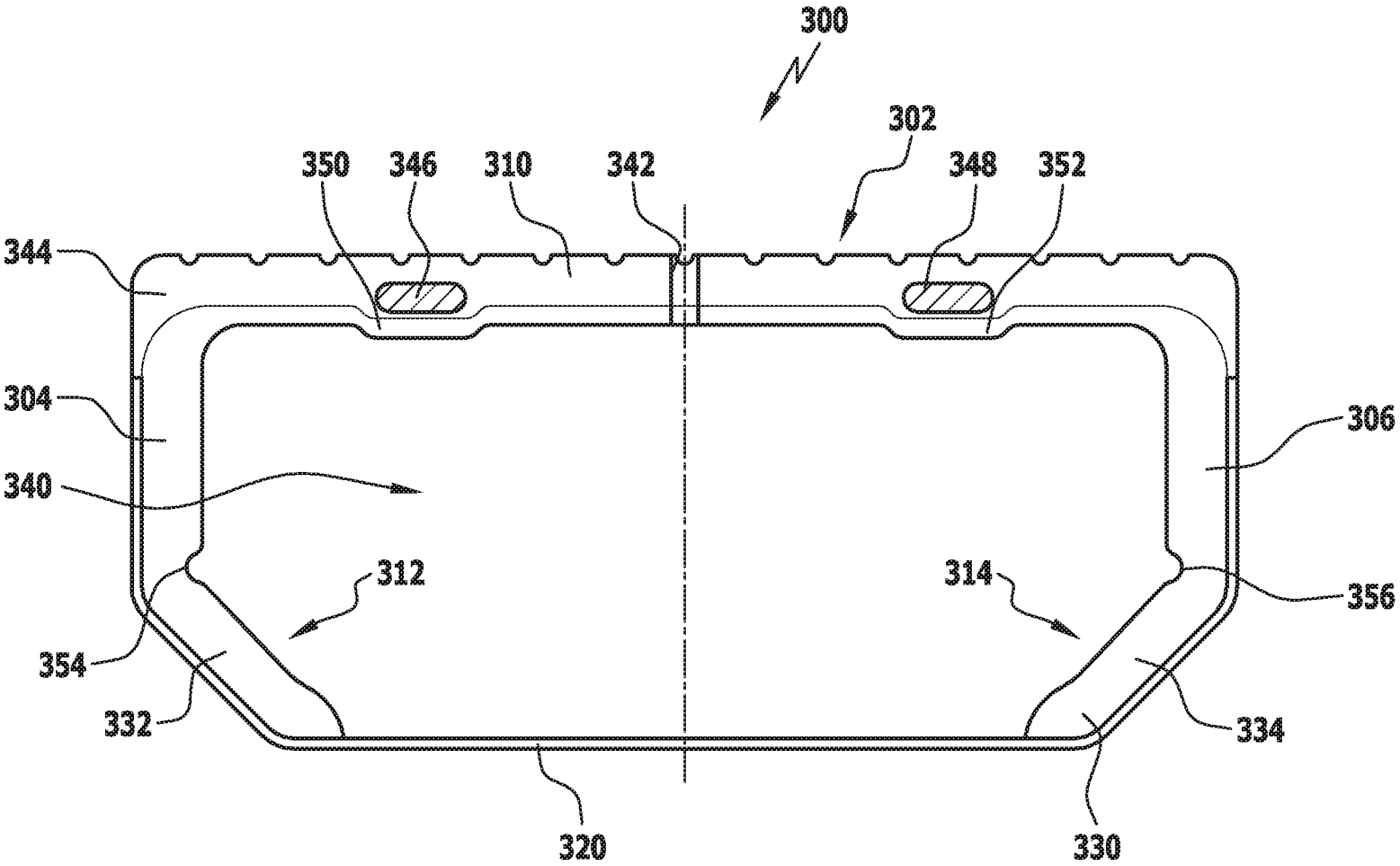
FIG. 4A: a further embodiment of a spacer in accordance with the invention.

In the case that the spacer comprises a closed outer wall 330, as shown in FIG. 4, it may be beneficial if the outer wall 330 in the regions aligned in parallel to the inner wall 310, which lie opposite the regions of the inner wall 310 that accommodate the reinforcing elements 346, 348, each has a recess 360, 362 that is formed complimentary to the greater thickness of the projections 350, 352 of the inner wall 310, and preferably corresponds to half of the thickness of the reinforcing elements 346, 348. FIG. 4A shows a variant in which the outer wall 330 is not closed.

Figure 5:
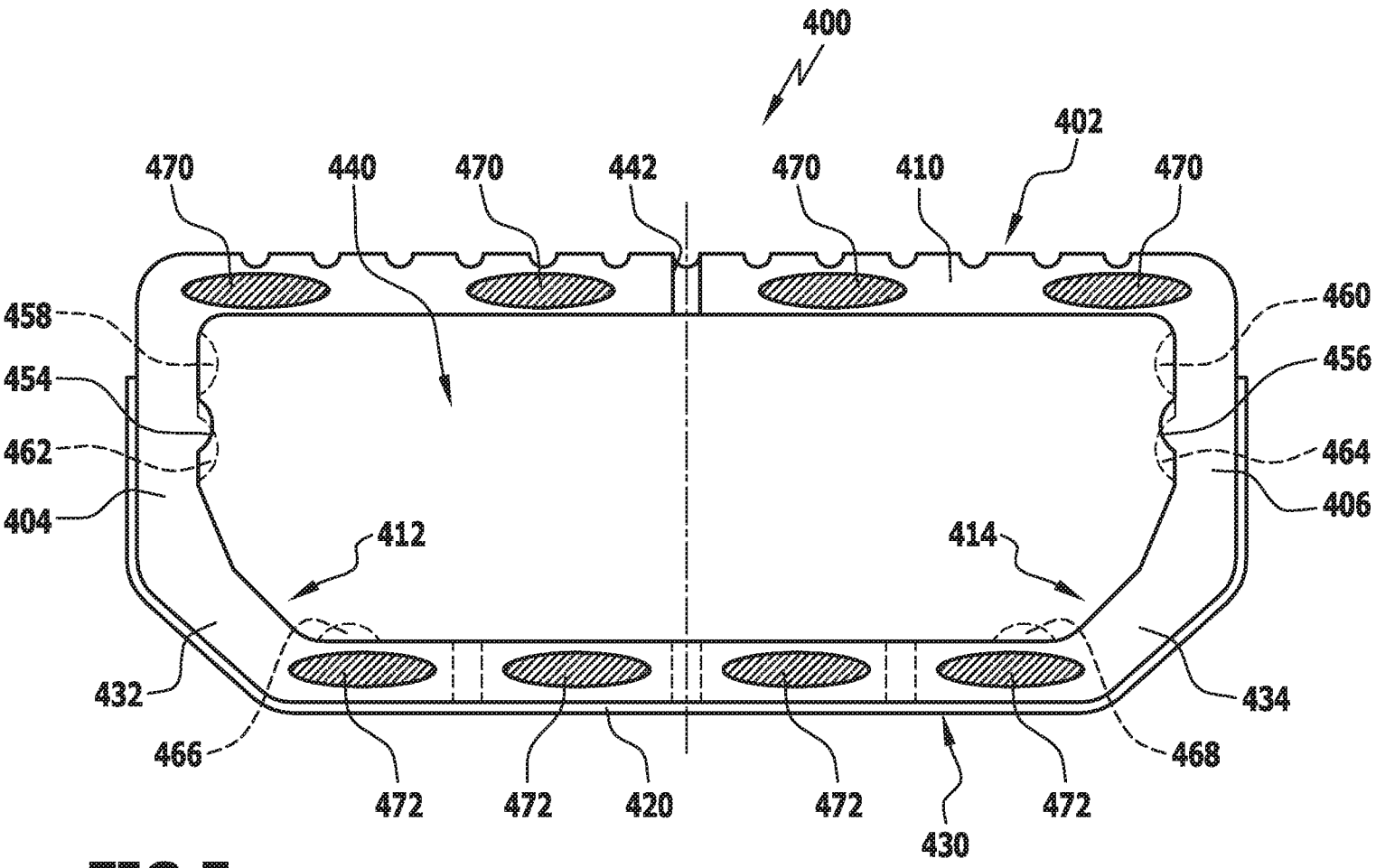
FIG. 5: a further embodiment of a spacer in accordance with the invention.

FIG. 5 shows a further embodiment of a spacer 400 in accordance with the invention in a cross section perpendicular to its longitudinal direction. The spacer 400 comprises a profile body 402 with first and second side walls 404, 406 arranged in parallel with free ends 412, 414, an inner wall 410 extending from the first side wall 404 to the second side wall 406, and an integrally formed outer wall 430 that extends from the first to the second side wall 404, 406 and that is arranged in parallel to and spaced apart from the inner wall 410. The free ends 412, 414 of the first and second side wall 404, 406 have chamfered end regions 432, 434 which are formed inclined toward each other.

The spacer 400 further comprises a vapor diffusion barrier 420 that extends from the first side wall 404 over the chamfered end regions 432, 434 and the outer wall 430 to the second side wall 406, abuts them from the exterior, and is arranged in a region between the chamfered end regions 432, 434 substantially in parallel to and spaced apart from the inner wall 410.

The vapor diffusion barrier 420 is preferably made of a three-layer polymer film out of polyethylene terephthalate (PET), wherein the outer layers each have on both sides and the middle layer has on one side a layer of aluminum formed by metal plating, each with a thickness of about 80 nm. The layers of the polymer film each have a thickness of about 12 μm.

The profile body 402 encloses a cavity 440 that is configured to communicate with an interspace between the panes (not shown) via periodically arranged perforation openings 442 in the inner wall 410. The interspace between the panes is, in the installed state in an insulating glass pane, enclosed by the spacer and glass panes.

In the present case, the profile body 402 is made of polypropylene (PP) and is typically produced integrally in an extrusion process.

The profile body 402 has reinforcing elements in the inner wall 410 and the outer wall 430 arranged in parallel to the longitudinal direction of the spacer 400, the reinforcing elements here in the form of fiber strands or rovings 470, 472 that, in the present case, are shaped elliptically in cross section.

The reinforcing elements 470, 472 may be incorporated in the outer wall 430 or between the outer wall 430 and the vapor diffusion barrier 420 in an arrangement as shown in FIGS. 3A and 3B. In that case, typically only two instead of four reinforcing elements are used.

An integral outer wall like the outer wall 430 of FIG. 5 has, in accordance with the invention, regularly arranged through holes that here are shown merely by means of broken lines. Possible variants of an integrally formed outer wall having through holes of the spacer in accordance with the invention are depicted in more detail in FIGS. 7A to 7C and in FIGS. 8 to FIG. 10.

The present through holes (shown with broken lines) in the outer wall may easily be formed between the fiber strands 472 in the outer wall 430, for example in the form of slits. In the present case, there are in each case four fiber strands 470, 472 regularly arranged in the inner wall 410 and the outer wall 430, wherein the four fiber strands 472 in the outer wall 430 seen in cross section perpendicular to the longitudinal direction of the spacer 400 are each arranged oriented vertically toward the four fiber strands 470 in the inner wall 410.

The profile body 402 also has an increased wall thickness toward the cavity 440 in regions in which the side walls 404, 406 transition into the chamfered end regions 432, 434.

Moreover, the profile body 402 has rib-shaped projections 454, 456 toward the cavity on the side walls 404, 406 in parallel to the longitudinal direction of the spacer 400. The rib-shaped projections 454, 456 are each arranged on the side walls 404, 406 at about 65% of the height with respect to a height of the spacer 400 from the outer wall 430 to the inner wall 410. The rib-shaped projections may, in particular in combination with the increased wall thickness, match the spacer 400 processed to a frame to conventional corner connectors, which are configured to be held in a press fit in corner regions in the cavity 440.

Further variants are depicted with broken lines, in accordance with which the rib-shaped projections 458, 460, 462, 464, 466, 468 may be arranged. In this variant, two rib-shaped projections 458, 460 are additionally formed toward the cavity in cross section perpendicular to the longitudinal direction of the spacer 400 on the side walls 404, 406 in regions in which the respective side wall 404, 406 connects to the inner wall 410.

Two further rib-shaped projections 462, 464 are arranged on the respective side wall 404, 406 toward the cavity 440 in regions in which the respective side wall 404, 406 connects to the region of increased wall thickness.

Also or alternatively, two further rib-shaped projections 466, 468 may be arranged on the outer wall 430 toward the cavity 440, each in regions in which the outer wall 430 connects to the respective chamfered wall region 432, 434.

These further variants in which the rib-shaped projections 458, 460, 462, 464, 466, 468 may be arranged, in combination with the regions of increased wall thickness, enable a matching of the inner contour of the cavity 440 to existing corner connectors, such that corner connectors may be held in the cavity 440 in a press fit and may thus stabilize the frame built from the spacer 400 in accordance with the invention in the corner regions.

Alternatively, frames may also be produced made from the spacer 400 by way of cold bending, wherein a longitudinal connector is then used to close the frame, which, like the aforementioned corner connectors, may be inserted into the cavity 440 of the spacer 400 in a force-fit manner.

Figure 6:
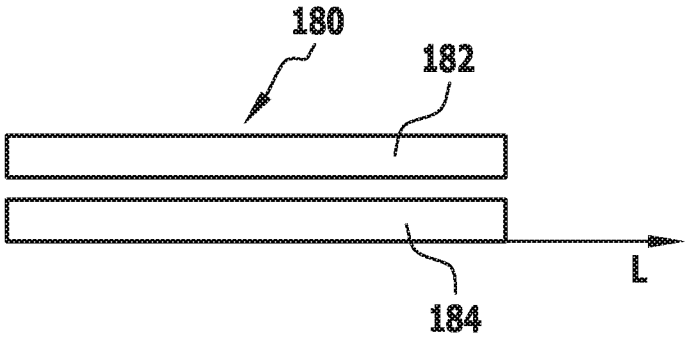
FIG. 6: a possible variant of the outer wall of a spacer in accordance with the invention.

FIG. 6 shows a possible variant of the outer wall 180 depicted in FIG. 2 of a spacer in accordance with the invention in a top view along the longitudinal direction L of the spacer. The longitudinal direction L is depicted by an arrow. The outer wall 180 comprises a first and a second wall segment 182, 184. The first and second wall segments 182, 184 are formed spaced apart from each other and in parallel to the inner wall (not depicted).

An opening is formed between the wall segments 182, 184 that, in the present case, is about 30% with respect to a total surface area of the outer wall 180.

Figure 7A:
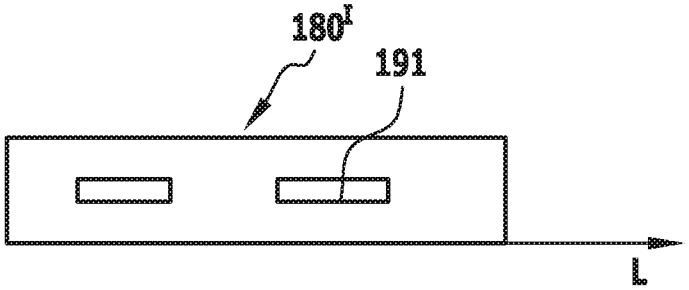
FIG. 7A to 7C: further variants of the outer wall of a spacer in accordance with the invention.
Figure 7B:
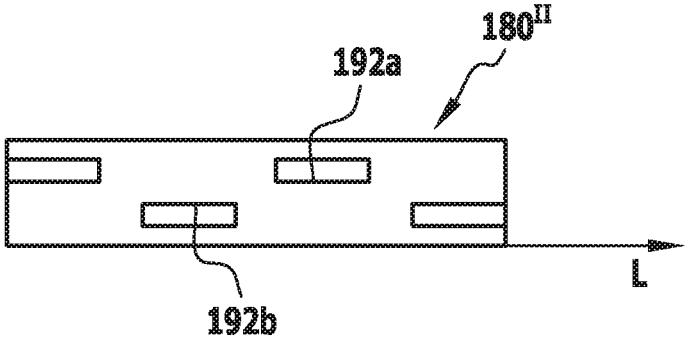
Figure 7C:
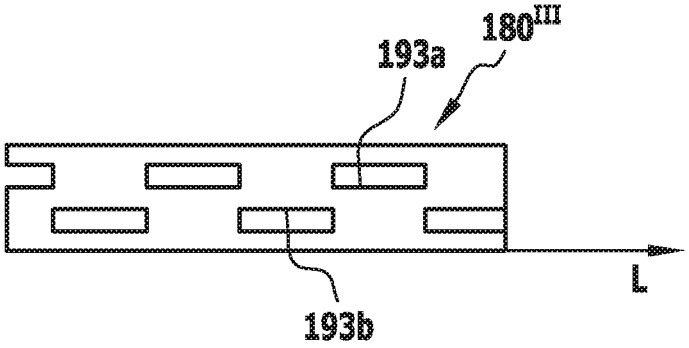

FIGS. 7A to 7C show further variants of the outer wall of a spacer in accordance with the invention in top view, as is shown in FIG. 2. FIG. 7A shows a variant of the outer wall of a spacer in accordance with the invention in which the outer wall $\mathbf{180}^{I}$ is integrally formed and has regularly arranged slit-shaped through holes 191 arranged periodically in a row whose longitudinal direction is aligned in parallel to the longitudinal direction L of the spacer. In the regions of the slit-shaped through holes 191, the cavity 190 is only closed by the vapor diffusion barrier 170 abutting the outer wall $\mathbf{180}^{I}$ from the exterior (not shown).

The through holes 191 have, in the present case, a free cross-sectional area of about 30% with respect to a total surface area of the outer wall $\mathbf{180}^{I}$.

FIG. 7B shows a further variant of how the outer wall of a spacer in accordance with the invention may be configured. The outer wall $\mathbf{180}^{II}$ is integrally formed and has a multitude of regularly arranged through holes 192*a*, 192*b*. The through holes 192*a*, 192*b* are formed in a slit shape whose longitudinal direction is oriented substantially in parallel to the longitudinal direction of the spacer. The slit-shaped through holes 192*a*, 192*b* having a longitudinal extension are arranged in two parallel rows and both rows are arranged offset from each other. The slit-shaped through holes 192*a*, 192*b* of the individual rows are each arranged at a distance from each other in longitudinal direction L, wherein the distance between two slit-shaped through holes 192*a*, 192*b* corresponds to about double the longitudinal extension of a slit-shaped through hole 192*a*, 192*b*.

The through holes 192*a*, 192*b* have, in the present case, a free cross-sectional area of about 40% with respect to a total surface area of the outer wall $\mathbf{180}^{II}$.

FIG. 7C shows a further variant of how the outer wall of a spacer in accordance with the invention may be configured. The outer wall $\mathbf{180}^{III}$ is integrally formed and has periodically arranged through holes 193*a*, 193*b*. The through holes 193*a*, 193*b* are, in the present case, slit-shaped and are formed having a longitudinal extension that is aligned in parallel to the longitudinal direction of the spacer. The through holes 193*a*, 193*b* are, in the present case, arranged in two parallel rows and the slit-shaped through holes 193*a*, 193*b* of the rows are arranged offset from each other and are overlapping in transverse direction. The path for the heat flow is thereby lengthened. The slit-shaped through holes 193*a*, 193*b* of the individual rows are each arranged at a distance from each other in longitudinal direction L that corresponds to about the longitudinal extension of a slit-shaped through hole 193*a*, 193*b*.

The through holes 193*a*, 193*b* have, in the present case, a free cross-sectional area of about 45% with respect to a total surface area of the outer wall $\mathbf{180}^{III}$.

Figure 8:
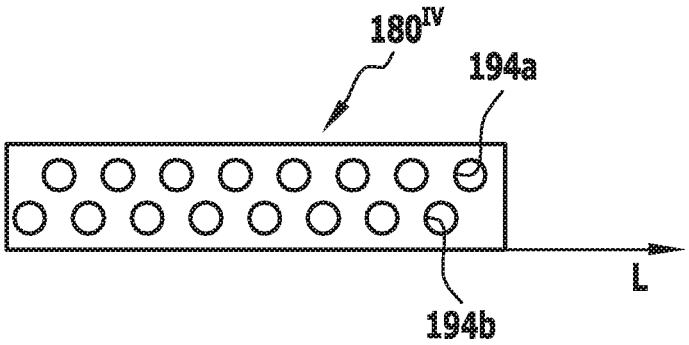
FIG. 8: A further variant of the outer wall of the spacer in accordance with the invention.

FIG. 8 shows a further variant of how the outer wall of a spacer in accordance with the invention may be configured. The outer wall $\mathbf{180}^{IV}$ is integrally formed and has regularly arranged through holes 194*a*, 194*b*. The through holes 194*a*, 194*b* have a circular cross section and are arranged in two parallel rows that are arranged in parallel to the longitudinal direction L of the spacer. The through holes 194*a*, 194*b* of the rows, which have a circular cross section, are arranged offset from each other.

The through holes 194*a*, 194*b* have, in the present case, a free cross sectional area of about 45% with respect to a total surface area of the outer wall $\mathbf{180}^{IV}$.

Figure 9:
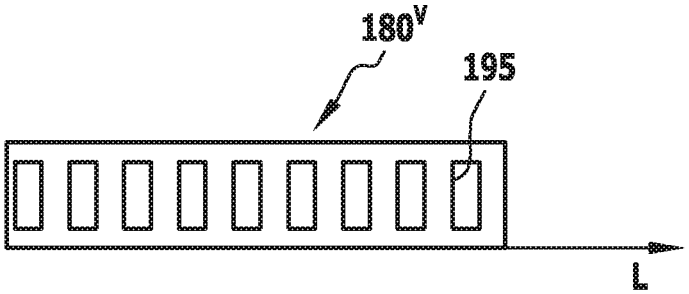
FIG. 9: a further variant of the outer wall of a spacer in accordance with the invention.

FIG. 9 shows a further variant of how the outer wall of a spacer in accordance with the invention may be configured. The outer wall $\mathbf{180}^{V}$ is integrally formed and has regularly arranged through holes 195. The through holes 195 are formed slit-shaped, wherein their longitudinal direction L is oriented perpendicularly to the longitudinal direction L of the spacer. The slit-shaped through holes 195 are arranged at a distance from each other in longitudinal direction L of the spacer and have a width in the longitudinal direction of the spacer that corresponds to the distance between two through holes 195 in longitudinal direction.

The through holes 195 have, in the present case, a free cross-sectional area of about 45% with respect to a total surface area of the outer wall $\mathbf{180}^{V}$.

Figure 10:
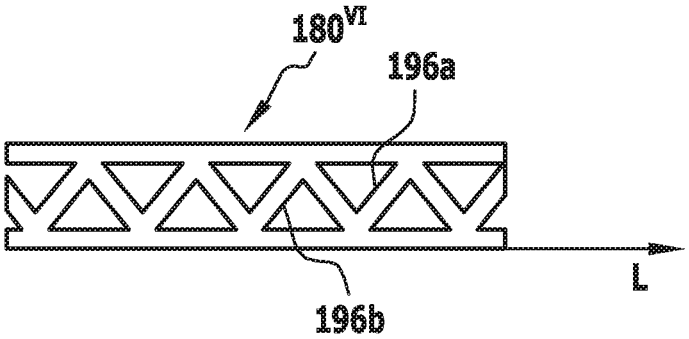
FIG. 10: a further variant of the outer wall of a spacer in accordance with the invention.

FIG. 10 shows a further variant of how the outer wall of a spacer in accordance with the invention may be configured. The outer wall $\mathbf{180}^{VI}$ is integrally formed and has regularly arranged through holes 196*a*, 196*b*. The through holes 196*a*, 196*b* are, in the present case, formed triangular in cross section, wherein one side of a triangular through hole 196*a*, 196*b* is arranged alternating pointing in parallel to the longitudinal direction in the direction of the first side wall (not shown) and one is oriented pointing in the direction of the second side wall (not shown). A vertex of the triangular through hole 196*a*, 196*b* subtending the side points in each case in the direction of the other side wall, respectively.

The through holes 196*a*, 196*b* have, in the present case, a free cross sectional area of about 60% with respect to a total surface area of the outer wall $\mathbf{180}^{VI}$.

The invention claimed is:

1. A spacer for insulating glass panes, comprising a profile body made using a first plastics material, having a main body with a substantially U-shaped cross section with first and second side walls arranged in parallel and an inner wall extending between the first and second side walls, and a vapor diffusion barrier made of a sheet material which is poorly heat conductive, wherein the first and the second side wall each have a free end which is spaced apart from the inner wall, wherein the vapor diffusion barrier is spaced apart from and extends substantially in parallel to the inner wall from the free end of the first side wall to the free end of the second side wall, and wherein the profile body together with the vapor diffusion barrier enclose a cavity seen in a cross section of the spacer, wherein the profile body comprises an integrally formed outer wall, which extends substantially in parallel to the inner wall from the first side wall to the second side wall, wherein the outer wall has a multitude of regularly arranged through holes, which have a round, oval, or polygonal free cross section, and wherein the vapor diffusion barrier is arranged abutting the outer wall from the exterior.

2. The spacer in accordance with claim 1, wherein the poorly heat conductive sheet material of the vapor diffusion barrier is different from the first plastics material.

3. The spacer in accordance with claim 1, wherein the vapor diffusion barrier extends over regions of the side walls and abuts the side walls from the exterior.

4. The spacer in accordance with claim 1, wherein the vapor diffusion barrier is selected from a single or multilayer thermoplastic polymer film, a thermoset polymer film, an elastomeric polymer film, and an ultrathin glass tape.

5. The spacer in accordance with claim 4, wherein the polymer film has a coating on its external surface.

6. The spacer in accordance with claim 5, wherein the polymer film has a thickness in the range of about 5 μm to about 60 μm.

7. The spacer in accordance with claim 4, wherein the polymer film is made out of a material selected from polyester, polyolefin, cyclo-olefin copolymers (COC), polyether, polyketone, polyurethane, polycarbonate, vinyl polymer, polyamide (PA), silicone, polyacrylonitrile, polymethylmethacrylate (PMMA), polyhalogen olefin, liquid crystalline polymer, and blends of these materials.

8. The spacer in accordance with claim 4, wherein the ultrathin glass tape has a thickness of about 100 μm or less.

9. The spacer in accordance with claim 4, wherein the ultrathin glass tape has a minimum bending radius of about 5 mm to about 8 mm.

10. The spacer in accordance with claim 1, wherein the vapor diffusion barrier comprises a stiffening element.

11. The spacer in accordance with claim 1, wherein the free ends of the first side wall and the second side wall each have a chamfered end region, wherein the chamfered end regions are inclined toward each other.

12. The spacer in accordance with claim 1, wherein the profile body comprises a multi-part outer wall with a first wall segment and a second wall segment spaced apart from each other transversely to a longitudinal direction of the spacer, wherein the first wall segment and the second wall segment are each connected to the free end of the first side wall and the second side wall, respectively, and extend away from the respective side wall and toward each other.

13. The spacer in accordance with claim 12, wherein the first wall segment and the second wall segment of the outer wall have substantially the same extension transversely to the longitudinal direction of the spacer and/or are substantially planar.

14. The spacer in accordance with claim 12, wherein the outer wall is made of the same material as the inner wall of the profile body.

15. The spacer in accordance with claim 11, wherein the side walls and optionally the outer wall in the interior of the profile body have one or more rib-shaped projections running in parallel to the longitudinal direction of the spacer.

16. The spacer in accordance with claim 11, wherein the profile body has a reduced wall thickness for the formation of articulation areas in the wall regions in which the integrally formed outer wall connects to the first side wall and the second side wall respectively, or the first wall segment and the second wall segment of the outer wall connect to the first side wall and the second side wall respectively, and/or in the side walls adjacent to their chamfered end regions.

17. The spacer in accordance with claim 1, wherein the through holes are arranged in two or more parallel rows.

18. The spacer in accordance with claim 1, wherein a first reinforcing element and a second reinforcing element are arranged in the inner wall in parallel to a longitudinal direction of the spacer profile, wherein the first reinforcing element is arranged in a first segment of the inner wall adjacent to the first side wall, and wherein the second reinforcing element is arranged in a second segment of the inner wall adjacent to the second side wall.

19. The spacer in accordance with claim 18, wherein the reinforcing elements are wire-shaped.

20. The spacer in accordance with claim 18, wherein the inner wall, in regions of the reinforcing elements, has projections extending in the direction of the cavity formed by the spacer, wherein the regions have a greater wall thickness than the adjacent regions of the inner wall.

21. The spacer in accordance with claim 18, wherein the outer wall in each of the regions aligned in parallel to the inner wall, which are opposite the regions of the inner wall accommodating the reinforcing elements, has in each case a recess.

22. The spacer in accordance with claim 1, wherein the first plastics material comprises polyolefin, polycarbonate (PC), polyvinyl chloride (PVC), styrene-acrylonitrile-copolymer (SAN), polyphenylene ether (PPE), polyester, polyamide (PA) and/or acrylonitrile butadiene styrene copolymer (ABS), and blends of these materials.

23. The spacer in accordance with claim 1, wherein the first plastics material has an amount of reinforcing fibers of about 1% by weight to about 80% by weight.

24. The spacer in accordance with claim 1, wherein the first plastics material comprises natural fibers.

25. The spacer in accordance with claim 1, wherein the profile body is formed with pores at least in portions of the inner wall and the side wall, and of the outer wall.

26. The spacer in accordance with claim 1, wherein the vapor diffusion barrier is bonded to the side walls and to the outer wall.

27. A method for the production of a spacer in accordance with claim 1, the method comprising providing the profile body, having a main body with a substantially U-shaped cross section, providing the vapor diffusion barrier out of a sheet material, aligning of the vapor diffusion barrier to the longitudinal direction of the profile body, and connecting the vapor diffusion barrier to the side walls and to the outer wall of the profile body, while forming a closed cavity as seen in the cross section of the spacer.

28. The method in accordance with claim 27, wherein the vapor diffusion barrier is coiled on a spool in a planar form.

29. The method in accordance with claim 27, wherein the vapor diffusion barrier is made of an ultrathin glass tape.

30. The method in accordance with claim 29, wherein the ultrathin glass tape, before being connected to the profile body, is heated to a shaping temperature.

* * * * *